US006832654B2

(12) United States Patent
Ravensbergen et al.

(10) Patent No.: US 6,832,654 B2
(45) Date of Patent: Dec. 21, 2004

(54) BOTTOM HOLE ASSEMBLY

(75) Inventors: John Edward Ravensbergen, Calgary (CA); Andre Naumann, Calgary (CA); Lubos Vacik, Calgary (CA); Mitch Lambert, Calgary (CA); Graham Wilde, Calgary (CA)

(73) Assignee: BJ Services Company, Houston, TX (US)

( * ) Notice: Subject to any disclaimer, the term of this patent is extended or adjusted under 35 U.S.C. 154(b) by 4 days.

(21) Appl. No.: 10/186,260

(22) Filed: Jun. 28, 2002

(65) Prior Publication Data

US 2003/0019628 A1 Jan. 30, 2003

Related U.S. Application Data

(60) Provisional application No. 60/302,171, filed on Jun. 29, 2001.

(51) Int. Cl.[7] ..... E21B 43/26

(52) U.S. Cl. ..... 166/308.1; 166/177.5; 166/181

(58) Field of Search ..... 166/98, 177.5, 166/181, 187, 191, 308, 372, 377, 387

(56) References Cited

U.S. PATENT DOCUMENTS

| | | | | | |
|---|---|---|---|---|---|
| 3,902,361 | A | * | 9/1975 | Watson | 73/152.57 |
| 4,246,964 | A | | 1/1981 | Brandell | 166/106 |
| 4,566,535 | A | | 1/1986 | Sanford | 166/113 |
| 4,569,396 | A | * | 2/1986 | Brisco | 166/305.1 |
| 4,749,035 | A | | 6/1988 | Cassity | 166/120 |
| 4,815,538 | A | | 3/1989 | Burroughs | 166/312 |
| 4,886,117 | A | | 12/1989 | Patel | 166/187 |
| 5,101,908 | A | | 4/1992 | Mody | 166/387 |
| 5,143,015 | A | | 9/1992 | Lubitz et al. | 166/187 |
| 5,267,617 | A | | 12/1993 | Perricone et al. | 166/387 |
| 5,361,836 | A | | 11/1994 | Sorem et al. | 166/187 |
| 5,383,520 | A | * | 1/1995 | Tucker et al. | 166/142 |
| 5,398,755 | A | | 3/1995 | Eslinger et al. | 166/187 |
| 5,692,564 | A | | 12/1997 | Brooks | 166/127 |
| 5,722,490 | A | | 3/1998 | Ebinger | 166/281 |
| 5,782,306 | A | | 7/1998 | Serafin | 166/387 |
| 6,533,037 | B2 | * | 3/2003 | Eslinger et al. | 166/319 |

OTHER PUBLICATIONS

SPE 68354 Formation Treating with Coiled–Tubing–Conveyed Straddle Tools; Richard Giroux, et al.

Baski, Inc. web pages at www.baski.com dated Jun. 24, 2002 (7 pages total).

* cited by examiner

*Primary Examiner*—David Bagnell
*Assistant Examiner*—Daniel Stephenson
(74) *Attorney, Agent, or Firm*—Howrey Simon Arnold & White, LLP

(57) ABSTRACT

A bottom hole assembly for use with fracturing or fracing a wellbore using coiled tubing is described having a first packing element and a second packing on a mandrel. The bottom hole assembly may be run into the wellbore such that the packing elements straddle the zone to be fraced. Also described is a timing mechanism to prevent the closing of dump ports before the bottom hole assembly may be flushed of the sand. A release tool is described that allows an operator to apply force to the coiled tubing to dislodge a bottom hole assembly without completely releasing the bottom hole assembly. Also disclosed is a collar locator capable of being utilized in a fracing process. Methods of using the above described components are also disclosed.

27 Claims, 22 Drawing Sheets

BOTTOM HOLE ASSEMBLY

CROSS-REFERENCE TO RELATED APPLICATIONS

This application claims priority to the Provisional Application 60/302,171, entitled "Bottom Hole Assembly" filed Jun. 29, 2001, incorporated herein in its entirety by reference.

BACKGROUND OF THE INVENTION

1. Field of the Invention

The present invention relates generally to packers for use in wellbores. More particularly, this invention relates to a bottom hole assembly for use with coiled tubing for the purpose of testing or fracturing ("fracing") a well.

2. Description of the Related Art

In the drilling and production of oil and gas wells, it is frequently necessary to isolate one subterranean region from another to prevent the passage of fluids between those regions. Once isolated, these regions or zones may be fraced as required.

Many stimulation techniques for given types of wells are better suited to using coiled tubing as opposed to solid mechanical structures such as wirelines. Generally, it is known to attach a packing device, such as a straddle packer, to a line of coiled tubing and run the packing device downhole until the desired zone is reached. Once positioned, the fracing proppant or sand slurry may be forced into the zone.

However, utilizing coiled tubing to fracture multiple zones can be problematic. The coiled tubing is generally weaker in tensile and compressive strength than its mechanical counterparts. Thus, coiled tubing may be unable to remove a bottom hole assembly that becomes lodged in the casing. Additionally, fracing facilitates the lodging of the bottom hole assembly in the casing as sand tends to accumulate throughout the bottom hole assembly. Thus, a fracing process which (1) requires multiple fracture treatments to be pumped via the coiled tubing and (2) requires that the bottom hole assembly to be repositioned within the multiple zones between treatments is a collision of objectives.

Additionally, the fracing process may be compromised if the proppant is underflushed such that sand slurry remains within the bottom hole assembly and even the coiled tubing. The additional sand can lodge between the bottom hole assembly and the casing. Consequently the coiled tubing may be partially plugged after each treatment.

Further, in the event that the well's casing integrity is breached, it is possible that proppant could be pumped into the well above the zone being treated, leading to the possibility of the coiled tubing being stuck in the hole. Further, the coiled tubing process requires the use of a zonal isolation tool or bottom hole assembly to be fixed to the downhole end of the coiled tubing. The tool may occupy almost the full cross-sectional area of the well casing which increases the risk of the tool or bottom hole assembly being lodged or stuck in the wellbore casing.

Once the bottom hole assembly becomes lodged, due to excess sand from the proppant becoming lodged between the bottom hole assembly and the wellbore casing, the tensile strength of the coiled tubing generally is not strong enough to be able to dislodge the bottom hole assembly. Therefore, the coiled tubing must be severed from the bottom hole assembly and retracted to surface. The bottom hole assembly must then be fished out of the well bore, or drilled or milled out of the well. These procedures increase the time and cost of fracing a zone.

Coiled tubing operations in deeper wells present another problem to operators trying to retrieve the bottom hole assembly and/or coiled tubing from a deep well. It is known to install release tools between the coiled tubing and the bottom hole assembly. Should it be desired to release the bottom hole tool, e.g. because the bottom hole assembly is irreparerably lodged in the casing, an upward force may applied to the coiled tubing to the release tool. The release tool is designed for the application of a known release force—less than the maximum force of the coiled tubing—upon which the release tool will release the bottom hole assembly, e.g. by shearing pins in the release tool. For shallow wells, the release force can be established at some given value less than the maximum strength of the coiled tubing.

However, in relatively deep wells, the weight of the coiled tubing detracts from the maximum force that may be applied to the release tool. Thus, the relase force cannot be known with certainty. In very deep wells, only a relatively small upward force may be applied to the bottom hole assembly, as the weight of the coiled tubing becomes substantial compared to the maximum force the coiled tubing can withstand. Thus, if the release force is set to low, the bottom hole assembly may be mistakenly released while operating in shallow portions of the well. However, if the release force is set high enough so that the bottom hole assembly will not be inadvertently released in the shallow portion of the well, then, when the bottom hole assembly is at deeper portions of the well, the coiled tubing may not have sufficient strength to overcome the weight of the coiled tubing to apply the required release force. Thus, the bottom hole assembly may become stuck in a deep well and the coiled tubing may not be able to retrieve it.

Fracing with coiled tubing can present yet another problem. In other coiled tubing operations, clean fluids are passed through the coiled tubing. Thus, fluid communication is generally maintained between the bottom hole assembly and the surface via the coiled tubing. However, in the fracing process, sand is pumped through the coiled tubing. The sand may become lodged in the coiled tubing, thus preventing fluid communication between the bottom hole assembly and the surface, thus lessening the likelihood that the bottom hole assembly may become dislodged once stuck.

Additionally, current fracturing work done on coiled tubing typically may experience communication between zones on a not-insignificant number of jobs (e.g. approximately 20% of the jobs). Communication between zones occurs due to poor cement behind the casing. Therefore the sand slurry exits in the zone above the zone being treated instead of into the formation. This sand could build up for some time before the operator realizes what has occurred. This sand build up again may lodge the down hole assembly in the wellbore.

Straddle packers are known to be comprised of two packing elements mounted on a mandrel. It is known to run these straddle packers into a well using coiled tubing. Typical inflatable straddle packers used in the industry utilize a valve of some type to set the packing elements. However, when used in a fracing procedure, these valve become susceptible to becoming inoperable due to sand build up around the valves.

One type of straddle packer used with coiled tubing is shown in FIG. 1. This prior art straddle packer 1 comprises two rubber packing elements 2 and 3 mounted on a hollow mandrel 4. The packing elements 20 and 30 in constant contact with casing 10 as the straddle packer is moved to isolate zone after zone.

In operation, the straddle packer 1 is run into the wellbore until the packers 2 and 3 straddle the zone to be fraced 30. Proppant is then pumped through the coiled tubing, into the hollow mandrel 4, and out an orifice 5 in the mandrel 4, thus forcing the proppant into the zone to be fraced 30. This type of straddle packer typically can only be utilized with relatively low frac pressures, in lower temperatures, and in wellbores of shallower depth. Wear on the packing elements 2 and 3 is further intensified when a pressure differential exists across the packer thus forcing the packing elements 2 and 3 to rub against the casing 10 all that much harder.

These prior art packers may be used in relatively shallow wells. Shallow wells are capable of maintaining a column of fluid in the annulus between the mandrel and the casing, to surface. The straddle packer when used to frac a zone is susceptible to becoming lodged in the casing by the accumulation of sand used in the fracing process between the annulus between the mandrel 4 and the casing 10. To prevent the tool from getting lodged, it is possible with these prior art packers used in shallow wells to clean out the sand by reverse circulating fluid through the tool. Fluid is pumped down the annulus, and then reversed back up the mandrel. Because the packing elements 2 and 3 only hold pressure in one direction, the fluid can be driven passed the packing element 2 to carry the sand into the mandrel and back to surface. Again, this is possible in shallow wells as the formation pressure is high enough to support a column of fluid in the annulus to surface. Otherwise, reverse circulation would merely pump the fluid into formation.

However, when zones to be fraced are not relatively shallow, the formation pressure is not high enough to support a column of fluid in the annulus from the zone to surface. Thus, the reverse circulation of fluid to remove excess sand from the tool is not possible, again increasing the likelihood that the packer may become lodged in the casing 10.

Further, because a column of fluid in the annulus to surface exists, the operator can monitor the pressure of the column and monitor what is transpiring downhole. However, without this column of fluid, such as in deep wells, the operator has no way of monitoring what is transpiring downhole which further increases the changes of the bottom hole assembly becoming lodged.

Thus, it is desirable to provide safeguards to prevent the bottom hole assembly from becoming stuck in the hole, especially when fracing relatively deep zones with coiled tubing. It is further desired to provide a mechanism by which a lodged bottom hole assembly may be "tugged" by the coiled tubing in an effort to dislodge the bottom hole assembly, without completely releasing the bottom hole assembly.

Another problem with fracing deeper wells with coiled tubing occurs when sand slurry is pumped through the bottom hole assembly at high flow rates. These high flow rates may cause erosion of the casing. Therefore, there is a need to perform the fracing process with coiled tubing which minimizes the erosion on the casing. Thus, a need exists for a bottom hole assembly capable of fracing using coiled tubing which minimizes erosion to the casing.

Therefore, there is a need for a bottom hole assembly that is capable of performing multiple fractures in deep wells (e.g. 10,000 ft.). Further, there is a need for the bottom hole assembly that may operate while encountering relatively high pressure and temperature, e.g. 10,000 p.s.i. and 150° C., and relatively high flow rates (e.g. 10 barrels/min.).

The present invention is directed to overcoming, or at least reducing the effects of, one or more of the issues set forth above.

SUMMARY OF THE INVENTION

An bottom hole assembly is described for use with coiled tubing for fracturing a zone in a wellbore having a casing, comprising a hollow mandrel functionally associated with the coiled tubing, the mandrel surrounded by an outer housing, the outer housing and the casing forming an annulus therebetween; an upper packing element; a lower packing element, the upper and lower packing elements disposed around the outer housing such that the packing elements are capable of straddling the zone to be fraced and are capable of setting the bottom hole assembly in the casing when the elements are set; an upper dump port in the outer housing, the upper dump port placing the annulus and a flow path within the hollow mandrel in fluid communication when an upward force is applied to the mandrel via the coiled tubing to deflate the upper and lower packing elements; and a timing mechanism to ensure the fluid communication continues for a predetermined time to prevent the dump port from closing before the bottom hole assembly is flushed.

In some embodiments, a release tool is described for use with coiled tubing to connect a bottom hole tool with the coiled tubing, the release tool comprising a release tool mandrel surrounded by a fishing neck housing; and a timing mechanism allowing a user to apply varying predetermined upward forces to the release tool via the coiled tubing for varying first predetermined set of lengths of time without apply sufficient force over time to release the bottom hole assembly from the coiled tubing.

In other embodiments, a collar locator is described. Also described is a method of using the above devices.

Additional objects, features and advantages will be apparent in the written description that follows.

BRIEF DESCRIPTION OF THE DRAWINGS

The following figures form part of the present specification and are included to further demonstrate certain aspects of the present invention. The invention may be better understood by reference to one or more of these figures in combination with the detailed description of the specific embodiments presented herein.

Figure 1:
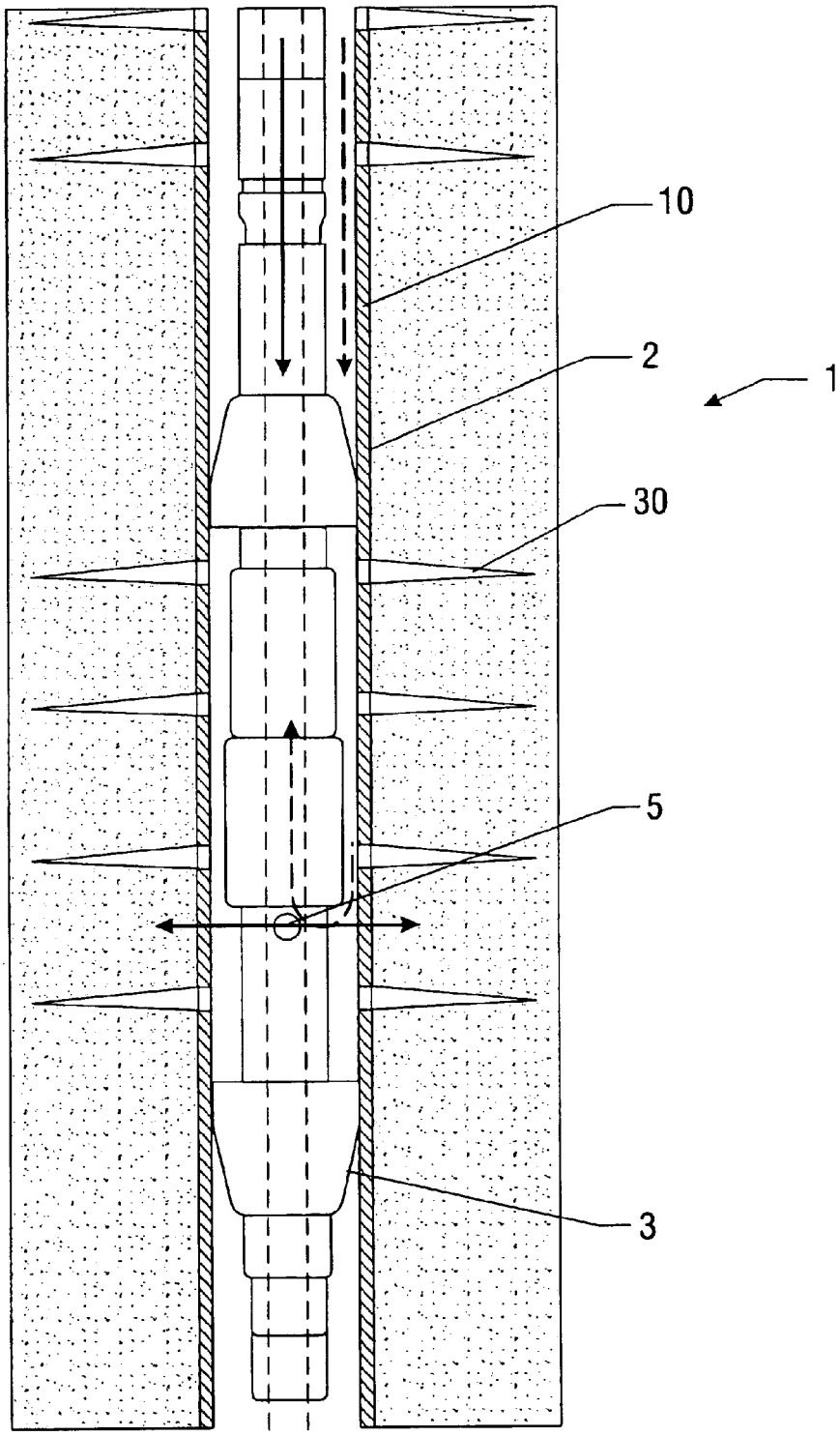
FIG. 1 (Prior Art)
FIG. 1 shows a prior art straddle packer.

While the invention is susceptible to various modifications an alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

Illustrative embodiments of the invention are described below as they might be employed in the fracing operation. In the interest of clarity, not all features of an actual implementation are described in this specification. It will of course be appreciated that in the development of any such actual embodiment, numerous implementation specific decisions must be made to achieve the developers' specific goals which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments of the invention will become apparent from consideration of the following description and drawings.

The following examples are included to demonstrate preferred embodiments of the invention. It should be appreciated by those of skill in the art that the techniques disclosed in the examples which follow represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

The present embodiments include a bottom hole assembly that may be utilized with coil tubing for the purpose of fracturing a well, even a relatively deep well. The embodiments disclosed herein may perform multiple fractures in relatively deep wells (e.g. depths to 10,000 feet). The embodiments disclosed herein may also be utilized with relatively high fracturing pressures (e.g. 10,000 p.s.i.), relatively high temperature (e.g. 150° C.), and relatively high flow rates (e.g. 10 barrels/min.).

Figure 2:
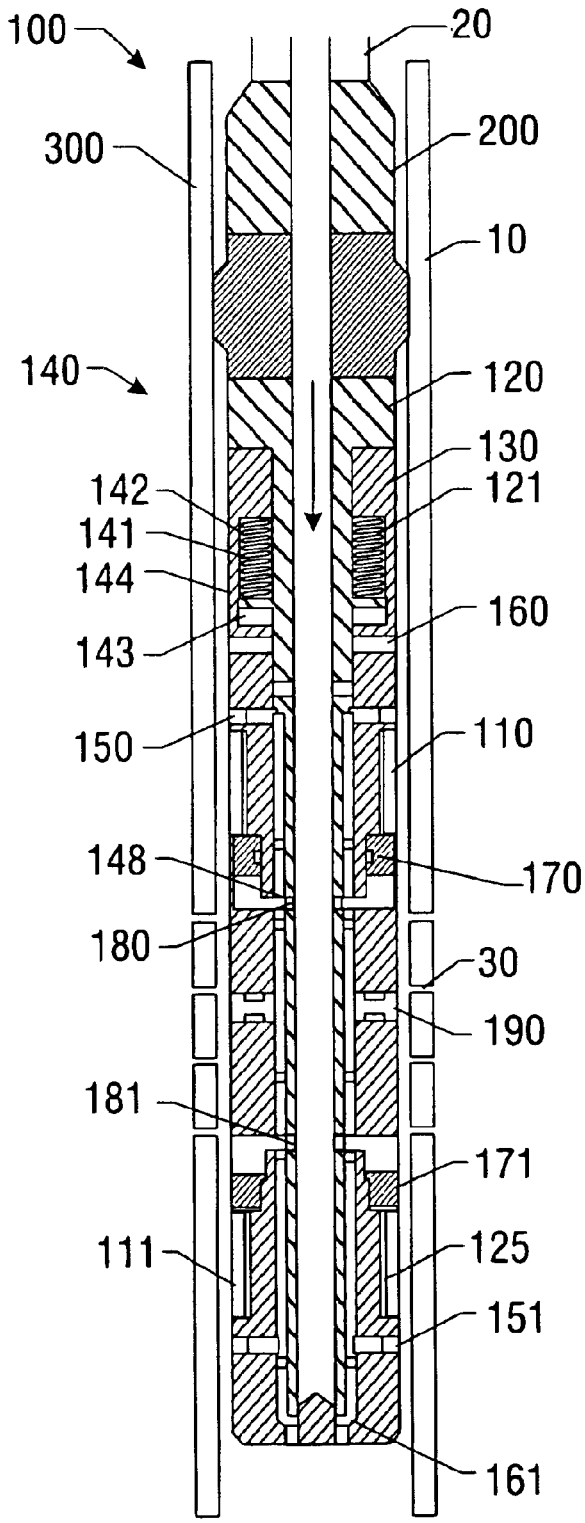
FIG. 2 shows a bottom hole assembly of one embodiment of the present invention having a timing mechanism.

Embodiments of the invention will now be described with reference to the accompanying figures. Referring to FIG. 2, one embodiment of the present invention is shown being utilized down hole within well casing 10. The bottom hole assembly 100 in some embodiments is connected to coiled tubing 20 by a release tool 200, the operation of which is described more fully herein with respect to FIGS. 7–22. A mechanical collar locator 300 may be connected to the release tool 200. The mechanical collar locator 300, described more fully with respect to FIG. 23, may be utilized to position the bottom hole assembly 100 near a zone to be fraced 30.

In some embodiments, the collar locator 300 is connected to the mandrel 120 of the bottom hole assembly 100. The mandrel 120 is shown in FIG. 2 circumscribed by outer housing 130 over most of its axial length. Positioned about the mandrel 120 and the outer housing 130 are two packing elements: upper packing element 110 and lower packing element 111. When in position for the fracing of a zone to occur, the upper packing element 110 and the lower packing element 111 straddle the zone to be fraced 30.

The bottom hole assembly 100 may be therefore considered a straddle packer. Further, the upper and lower packing elements 110 and 111 may be inflatable. Further, the upper and lower packing elements 110 and 111 may be formed from highly saturated nitrile (HSN) elastomer to withstand relatively high temperature and pressure applications. These packing elements 110 and 111 are able to withstand relatively high pressures, e.g. up to 10,000 p.s.i., at relatively high temperatures, e.g. 150° C., and may cycle between low and high pressures a minimum of twenty times.

The number of moving parts to perform a given function in for the bottom hole assembly 100 shown in FIG. 2 is minimized, as this tool may be used in a fracturing Sand Gelled Slurry environment. For instance, instead of using valves of the prior art to inflate packing elements, the upper and lower packing elements 110 and 111 are inflated by changing the flow rate of the fluid passing through the coiled tubing 20 and through the bottom hole assembly 100.

Also shown in FIGS. 2–6 are upper boost piston 170 and lower boost piston 171, which will be discussed more fully below. The bottom hole assembly 100 may also include top dump port 160 and bottom dump port 161 within outer housing 130, upper and lower filters 180 and 181 respectively, and upper and lower packer equalization ports 150 and 151 respectively. Finally, the bottom hole assembly 100 may include a timing mechanism 140.

In operation, the bottom hole assembly 100 is run into the casing 10 to the desired of the zone to be fraced 30. This depth may be determined via the mechanical casing collar locator 300 described more fully herein with respect to FIG. 23. The upper and lower packer elements 100 and 111 are set by increasing the flow rate of the fluid passing through the coiled tubing 20 and into mandrel 120 to a rate above the circulating flow rate between the annulus between the outer housing 130 and the casing 10. This increase in flow rate creates a pressure drop across the orifi 190.

This pressure drop inflates the upper and lower packer elements 110 and 111. To facilitate the inflation of the upper and lower packer elements 110 and 111, upper and lower pressure boost pistons 170 and 171 may be utilized. The upper and lower pressure boost pistons 170 and 171 reference the tubing pressure (the pressure outside the bottom hole assembly 100 between the upper and lower packing elements 110 and 111) and the annulus pressure.

Pressure boost pistons 170 and 171 are comprised of a cylinder having a base with a larger axial cross sectional area than its surface. The differential pressure between the tubing pressure and the annulus pressure creates an upward force on the base of the boost pistons 170 and 171. This upward forces is then supplied to the smaller surface area of the surface of the boost piston to create the pressure boost. This pressure boost assists in keeping the packing elements inflated. Otherwise, as soon as the flow rate through the bottom hole assembly drops to zero, the pressure drop across the orifice goes to zero, and the pressure in the packers is the same as the straddle pressure. With the pressure in the packers equal to the straddle pressure, the packers may leak fluid between the packers and the casing 10. This pressure boost may be approximately 10% of the tubing pressure. The moving pistons can be kept isolated from the dirty fracturing fluids with seals and filters. The volume of fluids passing through the filter is small.

The pressure drop across the orifi 190 to set the upper and lower packing elements 110 and 111 may be done in a blank casing 10 during a pressure test or when straddling the perforated zone 30 during a fracture treatment.

When fracing a zone 30, once the packers are set, sand slurry is then pumped through the coiled tubing 20, through the bottom hole assembly 100 and out orifi 190 and into the zone to be fraced 30. Once the fracing procedure is complete, the packing elements 110 and 111 will be deflated, the bottom hole assembly 100 moved to the next zone, if desired, and the process repeated.

Figure 3:
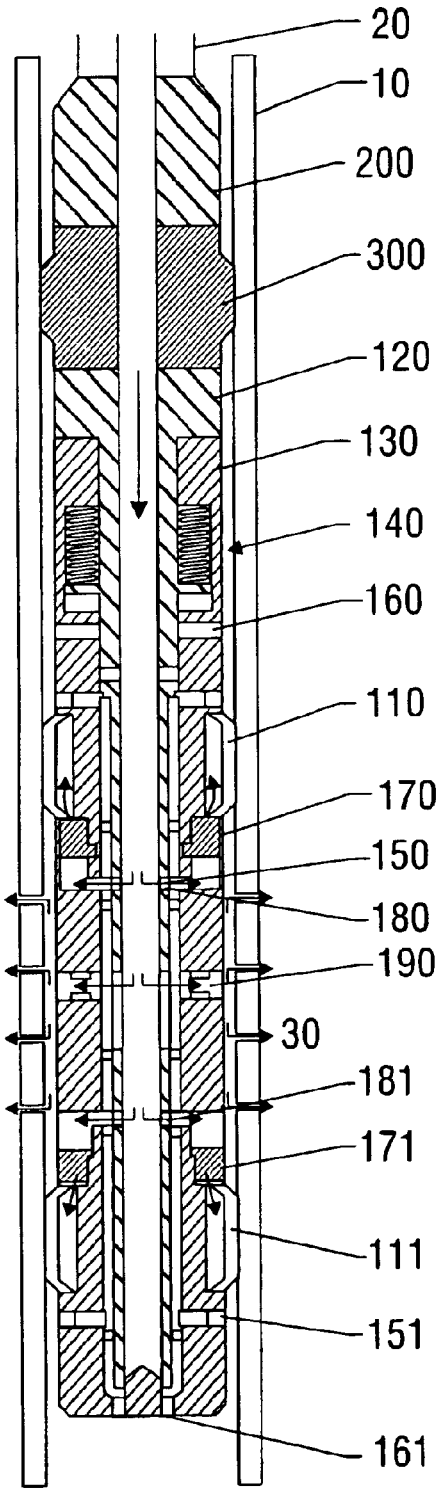
FIG. 3 shows one embodiment of the bottom hole assembly with the packing elements energized to frac the well.

FIG. 3 shows the bottom hole assembly 100 in the set position, i.e., with the packing elements 110 and 111 energized (inflated to contact casing 10) and the sand slurry being pumped down the coiled tubing, through the bottom hole assembly 100, and out the orifi 190 into the zone 30 to be fraced. When inflating the upper and lower packing elements 110 and 111, the flow rate is increased through the fracturing orifi 190 until a pressure differential is created inside the bottom hole assembly 100 to outside the bottom hole assembly 100.

Once the pressure differential across the fracturing orifi 190 is greater than the break out inflation pressure of the inflatable packing elements 110 and 111 (i.e. the pressure needed to inflate the packing elements into contact with the casing 10), the inflatable elements 110 and 111 inflate. As the packing elements 110 and 111 inflate, the pressure drop will continue to increase as the annular flow path (between the outer housing 130 and the casing 10) above and below the bottom hole assembly 100 becomes restricted by the packing elements 110 and 111.

Figure 4:
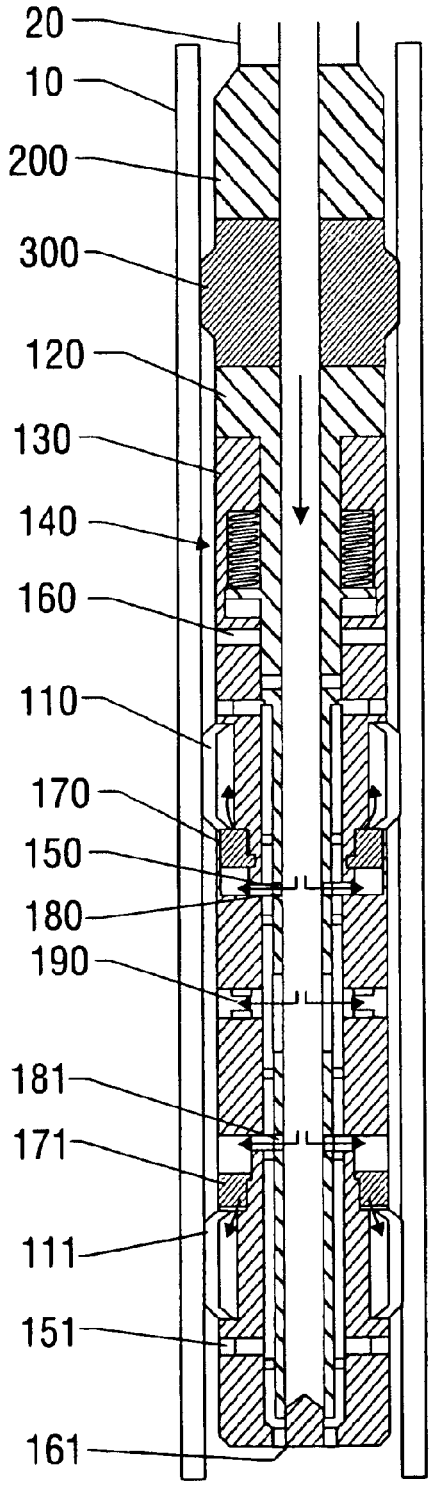
FIG. 4 shows one embodiment of the bottom hole assembly when used in a bottom hole assembly casing pressure test.

Occasionally, it is desired to set the bottom hole assembly 100 in blank casing (as opposed to straddling a zone 30 to be fraced) to test the functionality of the packing elements. The blank casing test of one embodiment of the present invention is shown in FIG. 4. In the event the packing elements 110 and 111 are set in blank casing 10 rather than across the formation with perforations in the casing 10, all flow paths become blocked. For instance, flow down the coiled tubing 20 and through the bottom hole assembly 100 exit orifi 190, then travels through the annulus between the bottom hole assembly 100 and the casing 10 until the flow contacts either upper packing element 110 or lower packing element 111. With no perforations in the casing 10, the flow rate must decrease and stop. When the flow rate stops the pressure differential from inside the bottom hole assembly 100 to outside the bottom hole assembly 100 decreases. In time, the pressure inside and outside the bottom hole assembly 100 will be equal.

Thus, in some embodiments, it is preferred that the pressure inside each packing element 110 and 111 be greater than the downhole pressure between the two packing element (i.e. the straddle pressure). Otherwise, the straddle pressure may force one or both of the packing elements 110 and/or 111 to deflate.

Conventional industry-wide straddle technology achieves this higher pressure inside the packing element by means of a pressure control valve. However, the fracing environment creates problems for the valves over time when resetting the packing elements multiple times.

To minimize sand accumulation, in some embodiments, the outer diameter of the bottom hole assembly 100 is 3½" for a standard 4½" casing 10. The 3½" outer diameter of the bottom hole assembly 100 is small enough to minimize sand bridging between the bottom hole assembly 100 and the casing 10 during the fracing process. Similarly, the outer diameter of the bottom hole assembly 100 may be 4½" for a standard 5½" casing 10. The 4½" outer diameter of the bottom hole assembly 100 is small enough to minimize sand bridging between the bottom hole assembly 100 and the casing 10 during the fracing process. In addition, increasing the cross sectional area of the bottom hole assembly 100 facilitates pressure containment and improves strength.

Also, to minimize the accumulation of sand in the annulus, and as shown in FIGS. 2–6, both the outer diameter and inner diameter of the bottom hole assembly 100 are straight and do not have upsets, as internal and external upsets hamper tool movement when surrounded by sand. The straight outer diameter of the bottom hole assembly 100 and a large annular clearance between the bottom hole assembly 100 and the casing 10 minimizes the likelihood of sand bridges forming and sticking the bottom hole assembly 10 in the wellbore.

The annular clearance preferably is greater than ×5 grain particles, even when a heavy wall casing has been used for casing 10 and 16/30 Frac Sand has been used as the proppant.

Preferably, the inflatable upper and lower packing elements 110 and 111 have an outer diameter to match the outer diameter of the bottom hole assembly 100, when the inflatable upper and lower packing elements 110 and 111 are in their deflated state, even after multiple inflations and deflations.

Figure 5:
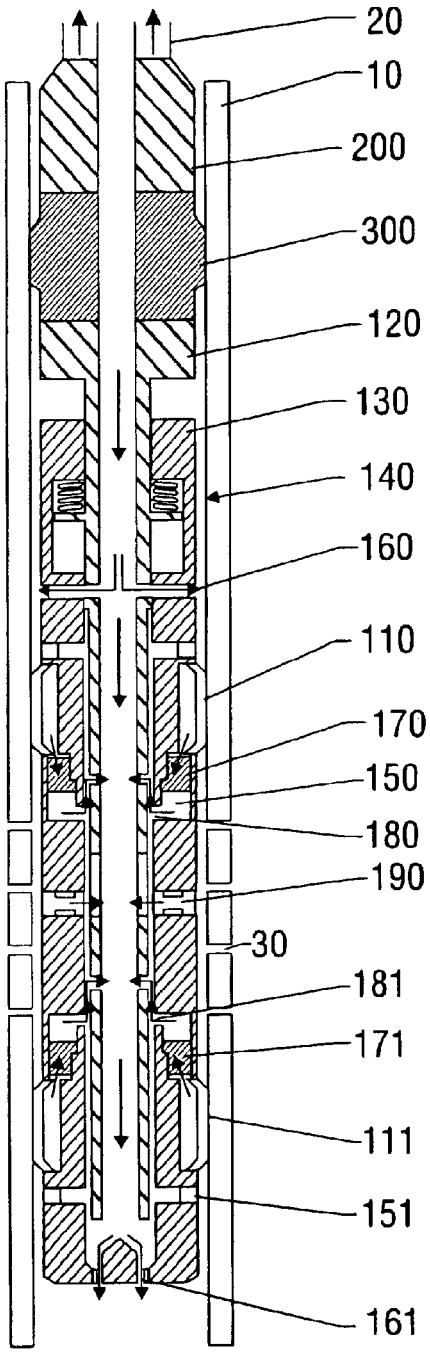
FIG. 5 shows one embodiment of the bottom hole assembly having its dump ports opened and the packing elements being deflated.

As shown in FIG. 5, the inflatable upper and lower packing elements 110 and 111 are each deflated by a direct upward pull on the top of the bottom hole assembly 100 via pulling upward on the coiled tubing 20. The upward pull causes movement between the mandrel 120 and the outer housing 130 of the bottom hole assembly 100, thus opening circulating ports (i.e. top dump port 160 and bottom dump port 161). With these dump ports 160 and 161 open, the packing elements 110 and 111 are deflated as pressure within each packing element is lost. The top dump port 160 and the bottom dump port 161 open to rid of under displaced fracturing slurry directly into the wellbore annulus and out of the bottom hole assembly 100.

Located between the upper packer element 110 and the lower packer element 111 are orifi 190 or fracing port in the outer housing 130 and mandrel 120. The orifi 190 provide fluid communication through the mandrel 120 and the outer housing 130 so that fracing slurry may proceed down the coiled tubing 20, through the mandrel 120, and into the zone to be fraced 30.

To deflate the packing elements 110 and 111, the pressure between the straddle packing elements 110 and 111 is released by pulling upward on the coiled tubing 20. Pulling upward on the coiled tubing 20 moves the mandrel 120 upward relative to the upper and lower packing elements 110 and 111, and relative to the outer housing 130 of the bottom hole assembly 100.

The embodiment of the bottom hole assembly 100 shown in FIGS. 2–6 includes a timing mechanism 140 to allow the dump ports to remain open long enough so that underdisplaced fluids are flushed from the bottom hole assembly 100. The timing mechanism 140 also prevents the upper and lower packing elements 110 and 111 from resetting before the under-displaced fracturing fluids can be circulated out of the bottom hole assembly. For instance, the timing mechanism 140 may be comprised of a spring 141 within a first upper compartment 142 formed between the outer housing 130 and the shelf 121 on the mandrel 120. A lower compartment 143 is formed between the outer housing 130 and the shelf 121 on the mandrel, below the shelf 121. A hole exists in the shelf 121 to allow hydraulic fluid 145 to pass between the compartments 142 and 143 as mandrel 120 moves axially with respect to outer housing 130. Springs 141 are located within the upper compartment 142 to bias the mandrel 120 in its lower-most position such that the upper dump port and the lower dump port are closed, i.e. the annulus and the flow path within the mandrel 120 are not in fluid communication.

An upward force may be applied to the mandrel 120 to open the upper dump port 160 and lower dump port 161. Ideally, the mandrel 120 will be fully stroked to its upper most position. Once stroked, the timing mechanism 140 begins to urge the mandrel 120 to its original location in which the upper and lower dump ports are closed. With the dump ports closed, the flushing of the bottom hole assembly 100 ceases. Typically, if the mandrel 120 is fully stroked (i.e. taken to its upper most position with respect to outer housing 130), approximately 10 minutes passes before the mandrel 120 returns to its original position closing the dump ports. By changing the parameters of the timing mechanism (i.e. hole 144 in the mandrel 120, size of upper and lower chambers 142 and 143, or changing the spring constant of springs 141), the amount of time the dump ports are open may change. However, in a preferred embodiment, it is desired to flush the bottom hole assembly for ten minutes before closing the dump ports so the timing mechanism 140 operates to keep the dump port open for approximately ten minutes (assuming, of course that the mandrel was fully stroked. If the mandrel 120 were only partially stroked, the ten minutes would be reduced.)

The timing mechanism 140 produces a time delay on the resetting of the mandrel 120 to ensure enough circulating time is provided such that all the under-displaced fracturing fluids can be circulated out of the bottom hole assembly 100 to prevent the bottom hole assembly from becoming stuck in the casing 10 should excess sand be present. Further the bottom dump port 161, once opened by the mandrel 120, provides a flow path through the bottom hole assembly and there are a minimum of directional changes for the slurry to navigate. This allows gravity to aide in the flushing and removal of the sand slurry from the bottom hole assembly 100.

It should be mentioned that once an upward force is applied to mandrel 120 and the dump ports 160 and 161 are open, the packing elements 110 and 111 do not instantaneously deflate. If they did, it would not be possible to give the mandrel 120 a full stroke, as it is the packing elements 110 and 111 would deflate and the bottom hole assembly 100 would move within the casing 10. Thus, a delay mechanism 148 is provided to allow the packing elements 110 and 111 to remain set for a short time so that the packing elements 110 and 111 do not instantaneously deflate. This delay mechanism 148 is comprised of the a flow restrictor in the port from the piston to the mandrel 120. The flow restrictor thus prevents the instantaneous deflation of the packing elements upon stoke of the mandrel 120. The delay mechanism 148 preferably is designed such that once the mandrel 120 is fully stroked, enough fluid has passed through the port from the piston to the mandrel to deflate the packing elements 110 and 111.

The materials for the mandrel 120 may be selected to minimize erosion. Typically, the maximum flow rate through the bottom hole assembly 100 is 10 bbl/min. In some embodiments, the inside diameter of the mandrel is one inch. Wear due to erosion may occur due to the high velocities and flow direction of the slurry. Carbourized steel combined with gelled fluids reduces the erosion such that these components can last long enough to complete at least one well, or fractures into ten zones, for example. Further, tungsten carbide may be used upstream of the orifi 190 due to the direction change of the frac slurry through the bottom hole assembly 100.

As shown in FIGS. 2–6, upper packer equalization port 150 and lower packer equalization port 151 act in conjunction with an annular space 125 between the mandrel 120 and the outer housing 130 to provide a bypass from above the upper packing element 110 below the lower packing element 111. This bypass, which remains open, prevents pressure from moving the entire bottom hole assembly 100 up or down the casing 10 if either packer element 110 or 111 were to leak. Should either of packer element 110 or 111 leak, the forces generated are capable of collapsing or breaking the coiled tubing string 20, thus losing the bottom hole assembly 100. The bypass thus acts to equalize the pressure above the upper packing element 110 and below lower packing element 111 so that large pressure differentials will not develop should a packing element fail.

Figure 6:
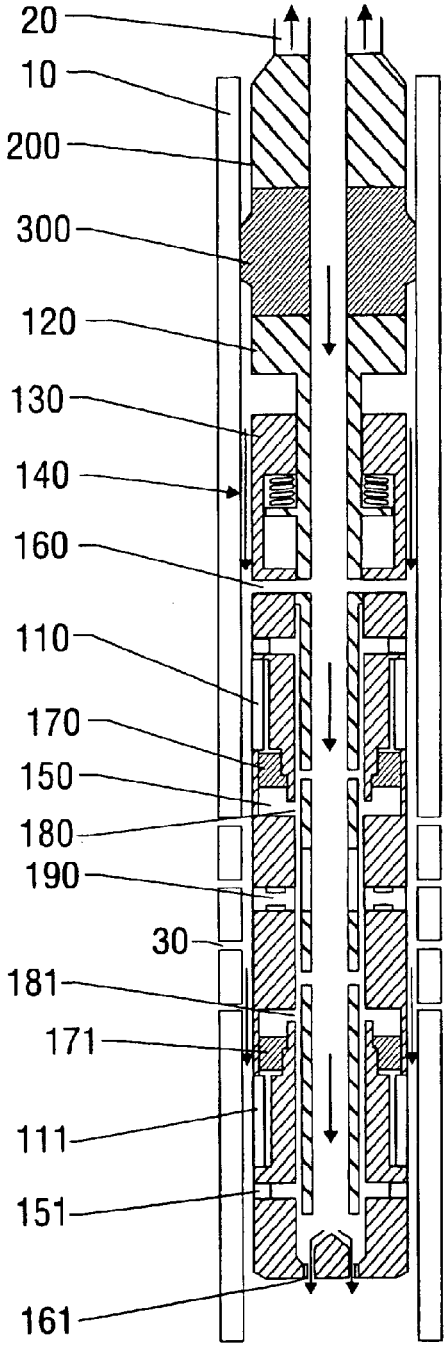
FIG. 6 shows one embodiment of the bottom hole assembly with the mandrel in the up position and the assembly being flushed.

Referring to FIG. 6, the bottom hole assembly 100 is shown in its "up" position (i.e. an upward force is being applied to the mandrel 120 via coiled tubing 20). In this position, bottom hole assembly and the annulus between the bottom hole assembly 100 and the casing 10 may be flushed to remove any sand particles which may have accumulated during the fracing process. The bottom hole assembly 110 may then be moved to the next zone, the bottom hole assembly 100 set, and the fracing process repeated on the new zone.

Figure 6A:
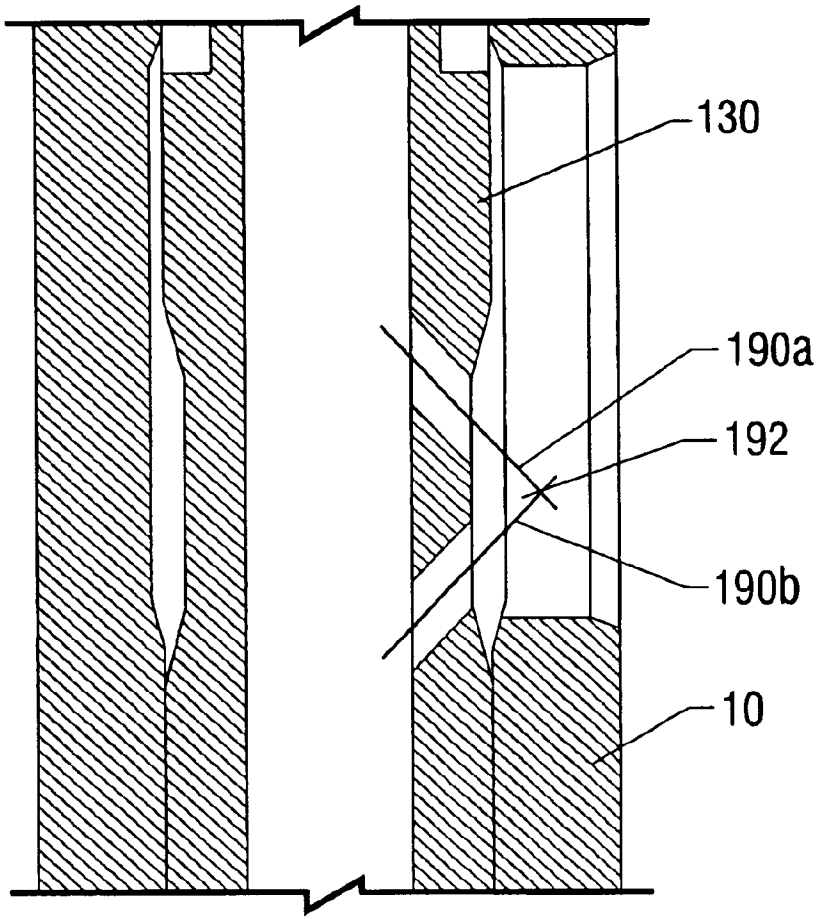
FIG. 6A shows an orifice configuration of one embodiment of the bottom hole assembly.

In some embodiments, the orifi 190 are not located in a single cross sectional plane. As shown in FIG. 6A, orifi 190 may be comprised of two orifi 190*a* and 190*b*. The two orifi 190*a* and 190*b* may form an angle 192. In some embodiments, the angle 192 formed by the two orifi is 90 degrees. In this embodiment, the two orifi 190 are orientated at angle 192 such that the energy in the flow paths exiting the orifi 190*a* and 190*b* will dissipate the energy of the flow of the sand slurry. This eliminates or reduces the erosion of the casing 10 and of the orifice. In other embodiments, one orifice is located between the packers upstream of at lease one flow guide, the flow guide changing the direction of the flow to funnel the slurring into the zone to be fraced 30. The flow guides are typically more robust and resistant to erosion than the orifi.

Referring to FIGS. 7–22, a release tool 200 for the bottom hole assembly 100 is shown. While the release tool 200 is also shown in each of FIGS. 2 and 3–6, the bottom hole assembly 100 disclosed therein does not require the release tool 200. The release tool 200 provides additional protection from having the bottom hole assembly 100 becoming stuck in the casing during the fracing operation.

Thus, in some embodiments, the bottom hole assembly 100 further comprises a release tool 200. The release tool 200 permits the user to disconnect the bottom hole assembly 100 from the coiled tubing 20 in the event the bottom hole assembly 100 becomes stuck in the hole. The release tool allows an operator to try to "jerk" the bottom hole assembly 100 loose from being lodged in casing. This gives the operator a chance to dislodge the bottom hole assembly 100 stuck in the casing, as opposed to simply disconnecting the bottom hole assembly 100 and leaving it in the well bore. The latter is the least preferable action as the bottom hole assembly 100 would then have to be fished out or drilled out before the fracing process may continue, which increases the time and costs of the operation.

The maximum axial force a string of coiled tubing 20 can withstand over a given period of time is generally known by the operator in the field. For example, in some embodiments, the release tool 200 permits the user to pull to this maximum force the coiled tubing 20 string can withstand for short periods of time without activating the release tool 200 to release the bottom hole assembly 100. If the release tool is activated, the remaining portion of the bottom hole assembly 100 are left stuck in the well.

As mentioned above, because the embodiments disclose herein may be used in relatively deeper wells, it is not generally possible to determine the exact force necessary to release the bottom hole assembly. And as the bottom hole assembly is run deeper and deeper in the well, the maximum upward force that can be applied to the bottom hole assembly becomes less and less (due to the weight of the coiled tubing in the hole and the limitation s of the maximum). The present release tool overcomes this problem by providing the operator various options when manipulating the bottom hole tool. For instance, the operator may apply a relatively high impact force for a very short time (e.g. to try to dislodge the bottom hole assembly) without releasing the bottom hole assembly completely. Alternatively, if the operator really wants to release the bottom hole assembly, but the bottom hole assembly is relatively deep in the well, a relatively low force (which may be all that the coiled tubing can provide in deep areas as described above) may be applied for a relatively long time to release the bottom hole assembly.

The release tool 200 has a time delay within a reset mechanism to achieve this function. This is advantageous as it gives the user maximum opportunity to get out of the hole, yet still allows for a disconnect if necessary. The release tool also has a warning in the way of a circulating port 280 to warn the user disconnect is imminent. Therefore, to disconnect and leave the bottom hole assembly 100 in the well, the user must pull in a range of predetermined forces for a determined length of time. For example the user may pull 15,000 lbs. over string weight for a period of 30 minutes before releasing the bottom hole assembly 100. Alternatively, the user may pull 60,000 lbs. over string weight for 5 minutes without disconnecting.

Figure 7:
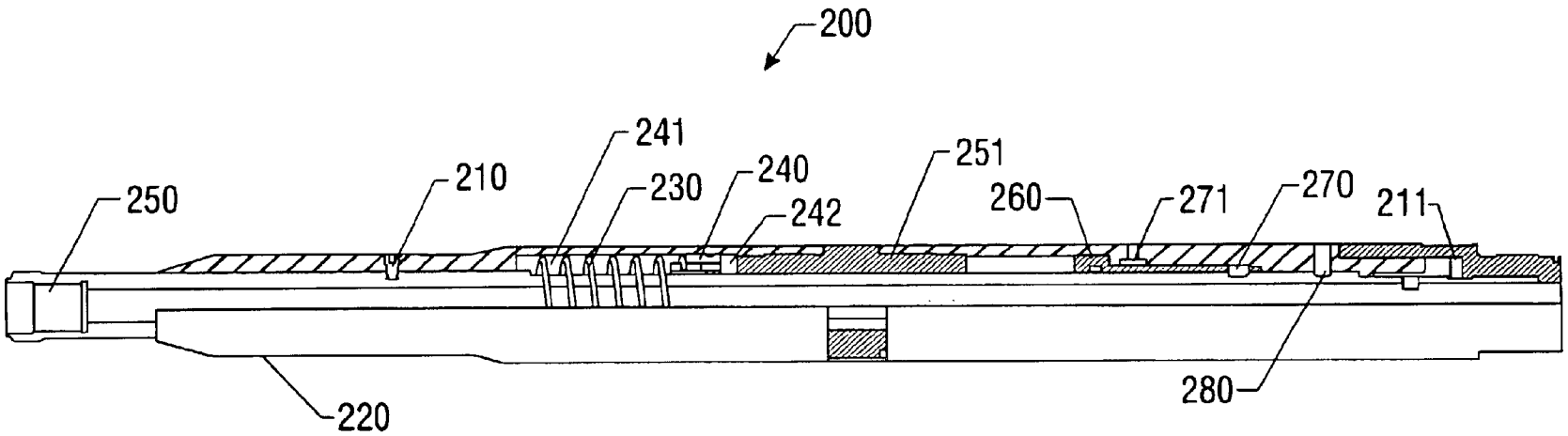
FIG. 7 shows one embodiment of the release tool of a bottom hole assembly.

Referring to FIG. 7, a release tool 200 of one embodiment of the present invention is shown having a release tool mandrel 250. A fishing neck housing 220 surrounds the mandrel 250, the mandrel being axially movable within the fishing neck housing 220. Between the fishing neck housing 220 and release tool mandrel 250 are upper shear pin 210 and lower shear pin 211.

The release tool 200 may also include a reset mechanism to allow the operator to apply varying amounts tension varying amounts of time (as described hereinafter) to try to jerk the bottom hole assembly 100 out of the casing, should the bottom hole assembly 100 become lodged in the casing. The reset mechanism may include a balance piston 240 attached to the release tool mandrel 250. Located above below piston 240 and encircling release tool mandrel 250 is relief valve 251. Below the relief valve 251 is lower piston 260, which also circumscribes the release tool mandrel 250, the lower piston having a key 270. The fishing neck housing 220 has a circulating port 280 on its lower end.

The balance piston 240 further comprises a second pressure relief valve 243 and a flow restricter 244. Above the balance piston 240 is an upper chamber 241 having hydraulic fluid. Below balance piston 240 is lower chamber 242. As the release tool mandrel 250 moves upwardly with respect to the fishing neck housing 200, the pressure release valve 251 cracks to allow hydraulic fluid to pass from the lower chamber—now extending from the balance piston, through the first relief valve 251, and to the lower piston 260—to the upper chamber 241. In addition, the flow restrictor 244 controls the rate of flow between the upper and lower chambers. Further, the first pressure relief valve 251 determines the force required to begin the actuation of the release tool. If the upward force is removed from the inner mandrel, the spring 230 reverses this process, forcing hydraulic fluid from the lower chamber 242 to the upper chamber 241 at a rate determined by the flow restrictor.

Figure 8:
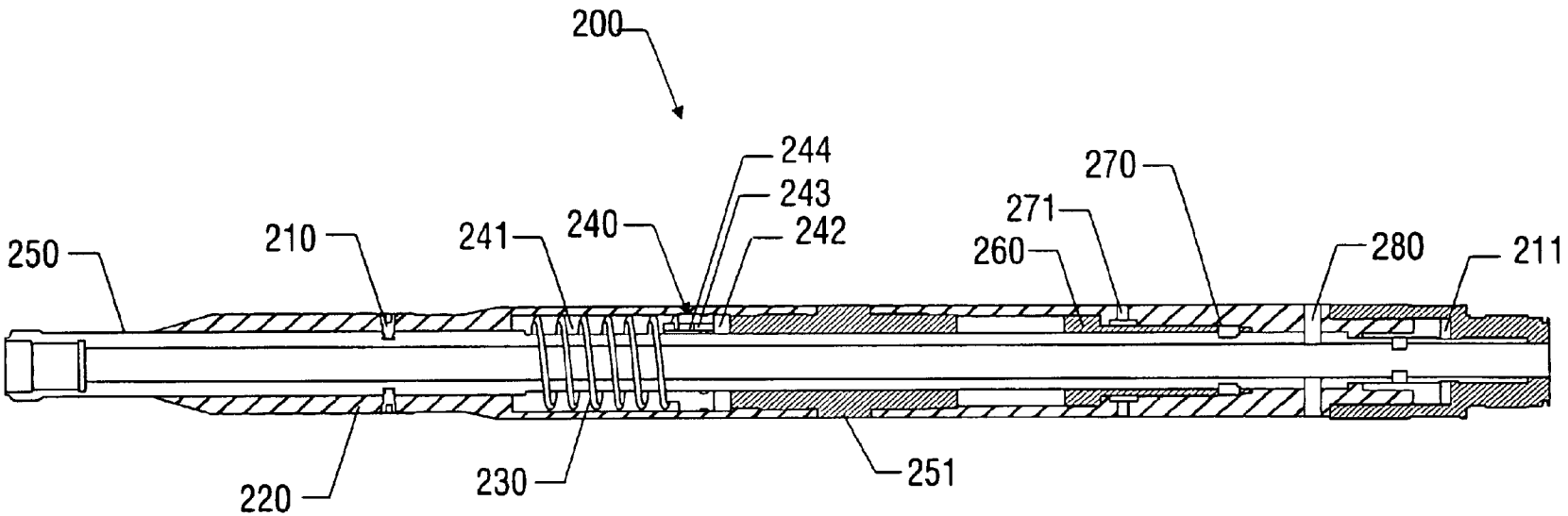
FIG. 8 shows one embodiment of the release tool in the running configuration.

The operation of the release tool 200 will now be described in conjunction with FIGS. 8–22. FIG. 8 shows the release tool 200 when being run in the hole. The release tool has not been "stroked" at all, i.e. the release tool mandrel 250 is in its lowermost position.

The release tool allows for a three-stage release. The first stage allows the user to jerk the bottom hole assembly 100 in the casing 10 at various forces for various times without totally releasing the bottom hole assembly. As the maximum time/tension settings are reached, a circulating port opens to indicate that the bottom hole assembly 1000 is about to be released. If the user does not wish to release the bottom hole assembly 100, the user may cease apply force and the release tool 200 will reset to its original state.

In stage two, additional force may be applied. Circulation is still possible. However, the tool cannot be reset at this point.

Finally, in stage 3, the bottom hole assembly 100 is released as the release tool mandrel 250 is completely pulled out of the fishing neck housing 220.

Figure 9:
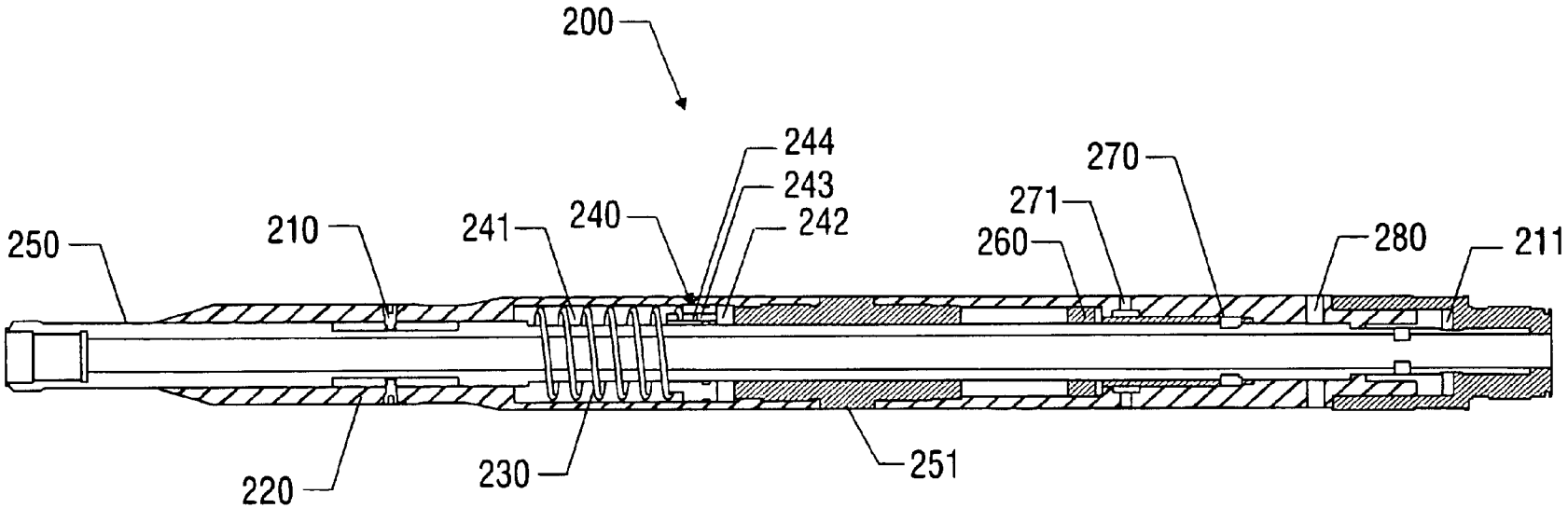
FIG. 9 shows one embodiment of the release tool that is partially stroked to close the circulating port with shear pins not sheared.
Figure 10:
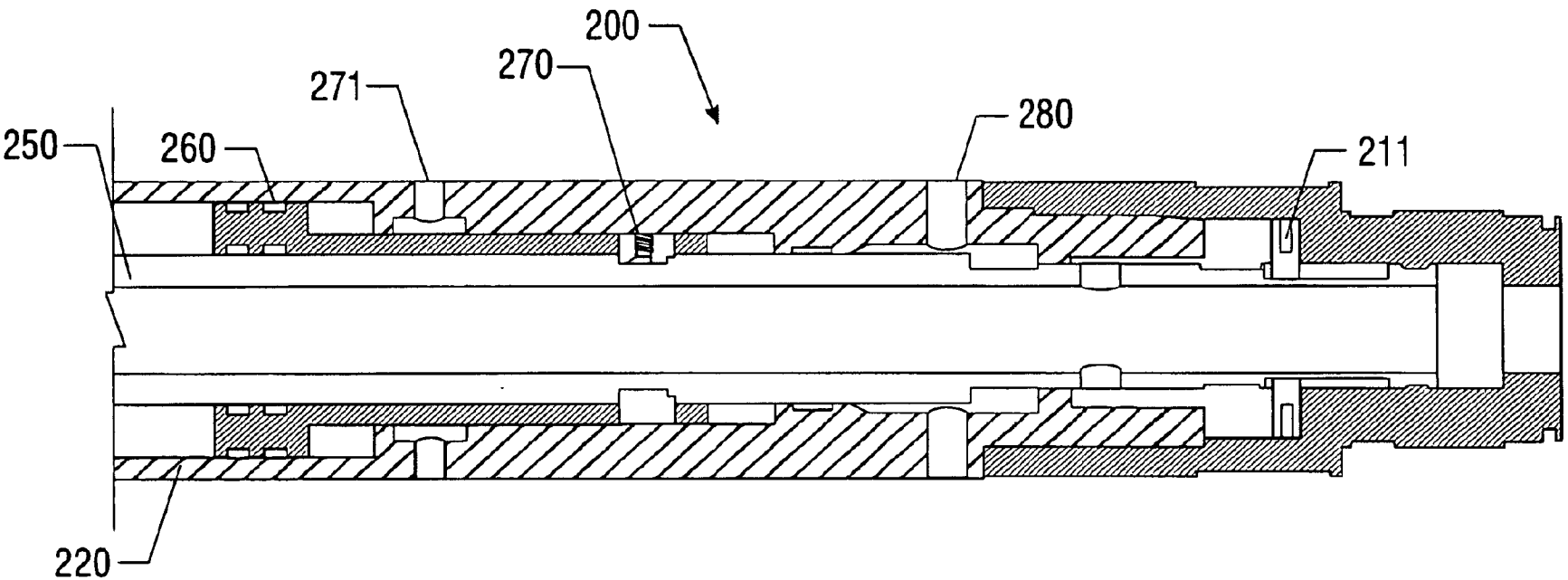
FIG. 10 shows a close up of the lower portion of the release tool of one embodiment of the bottom hole assembly.

FIGS. 9 and 10 show the release tool 200 at the beginning of the first stage of being approximately 20% stroked. The release tool mandrel 250 has moved upwardly with respect to fishing neck housing 220 as a result of an operator on the surface pulling the coiled tubing 40 out of the hole. This upward force is transferred from the coiled tubing 40 to the release tool mandrel 250, from the mandrel 250 to the key 270, from the key 270 to the lower piston 260, from the piston 260 to the fluid, and from the fluid to the pressure relief valve 251. Therefore, if the force is sufficiently large, the relief valve will open allowing the mandrel 250 to move.

As the release tool mandrel 250 moves upwardly with respect to the fishing neck housing 200, the second pressure relief valve 243 breaks to allow hydraulic fluid to pass from the upper chamber 241 to the lower chamber 242. This occurs, for example, at 24,000 lbs. The release tool mandrel travels up hole, e.g. two inches, until the lower shear pins 211 engages. Typically, this takes about ten minutes to go two inches stroke at 26,000 pounds pull. Alternatively, it may take about three minutes at 80,000 lbs. pull.

Figure 11:
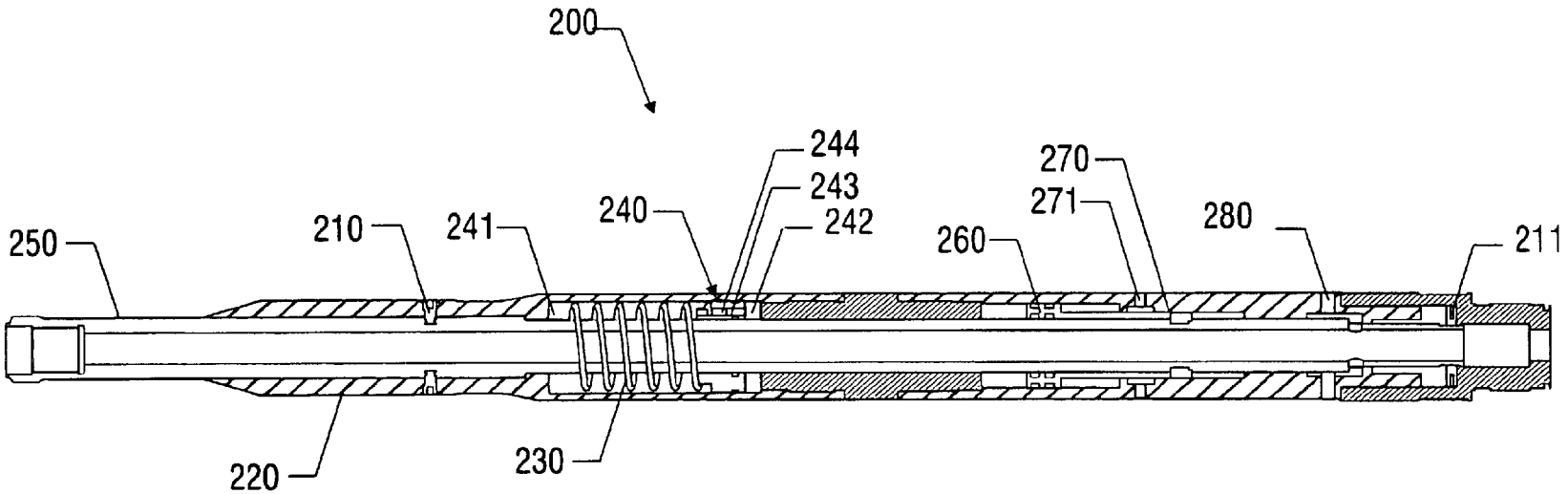
FIG. 11 shows the release tool of one embodiment of the bottom hole assembly 50% stroked with the circulation ports open and the shear pins contacting the shoulder but not sheared.
Figure 12:
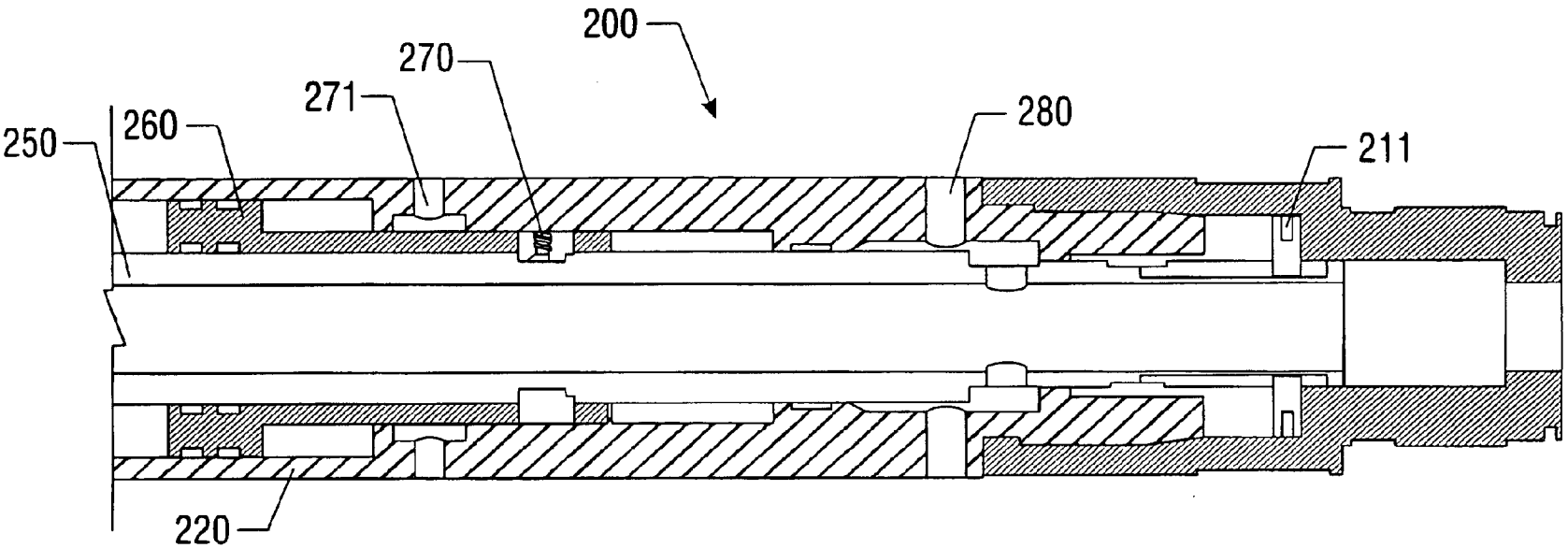
FIG. 12 shows a detailed view of the release tool of FIG. 11.

After application of additional force or for the same force for a longer period of time, the release tool 250 continues its upward travel or stroke. As shown in FIGS. 11 and 12, after, e.g., another 1.25" stroke, the circulation ports open to let the operator know that the tool may be released. At this point, the lower shear pins 211 are against the shoulder of the fishing neck housing 220, but are not sheared. Therefore, the spring 230 will return the release tool 200 to its original state once the upward force on the release tool mandrel 250 is removed.

Figure 13:
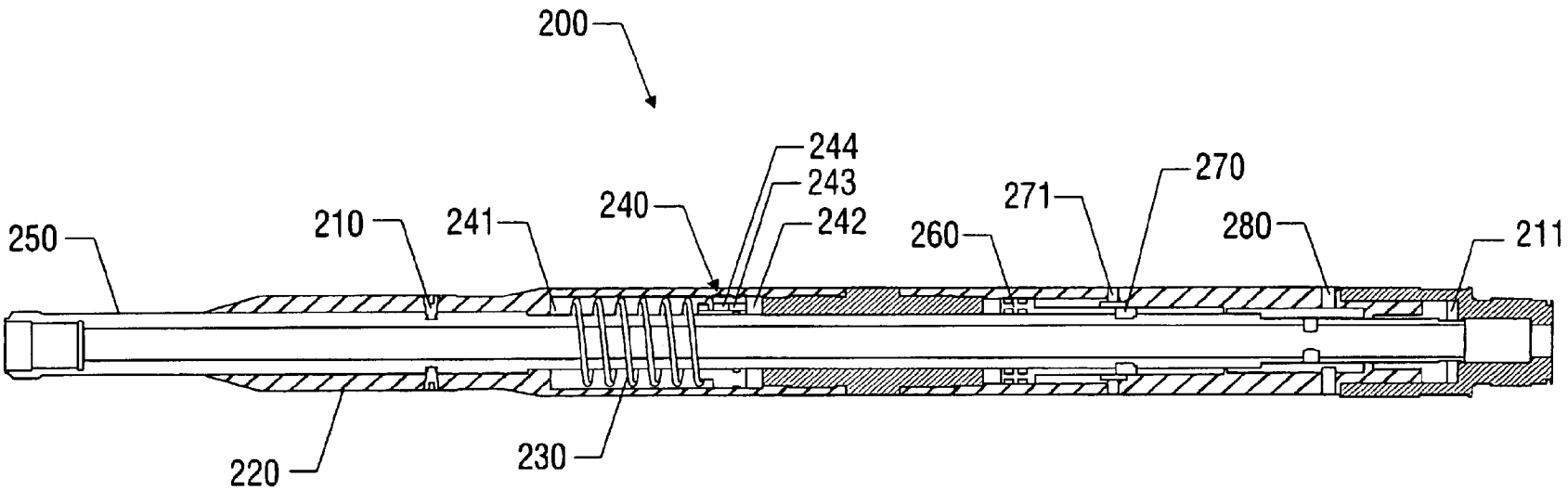
FIG. 13 shows the release tool of one embodiment of the bottom hole assembly being 85% stroked with the circulation port open and the shear pins sheared.
Figure 14:
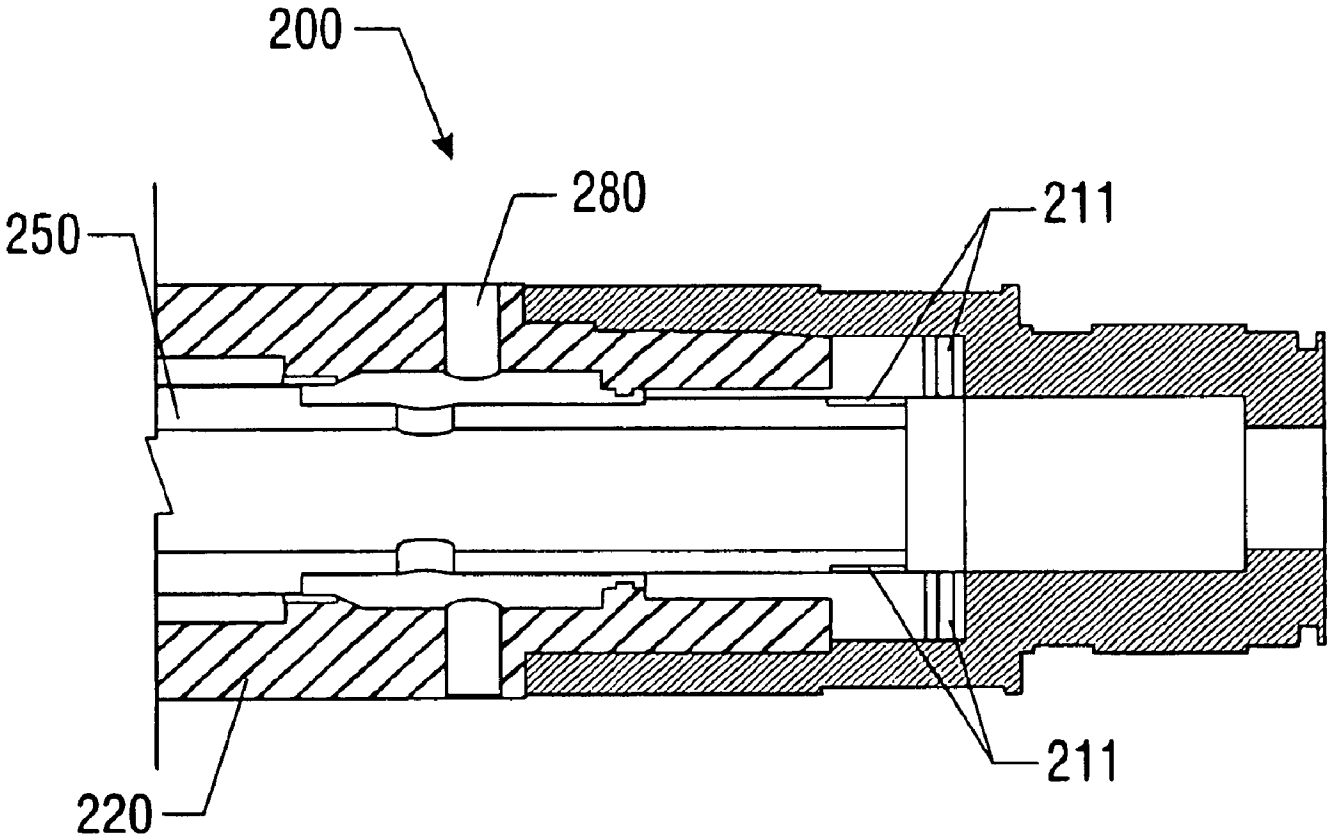
FIG. 14 shows a detailed view of the lower section of the release tool of FIG. 13 with the pins sheared.
Figure 15:
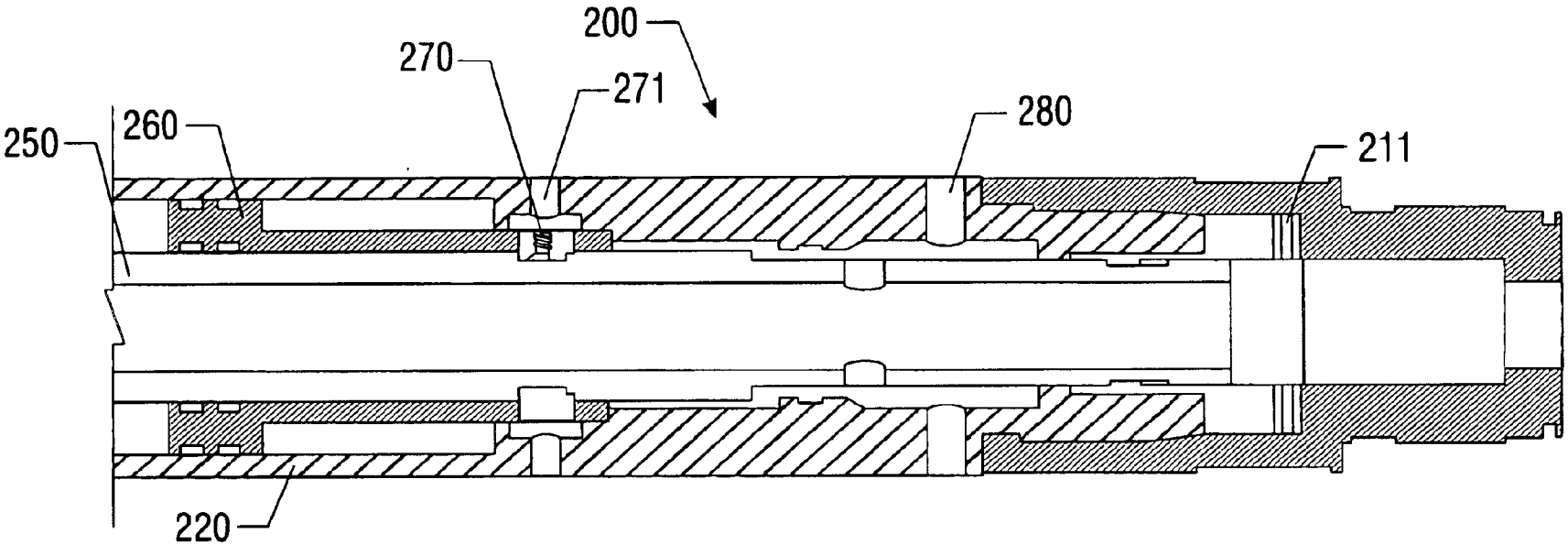
FIG. 15 shows a detailed view of the lower section of the release tool of FIG. 15.
Figure 16:
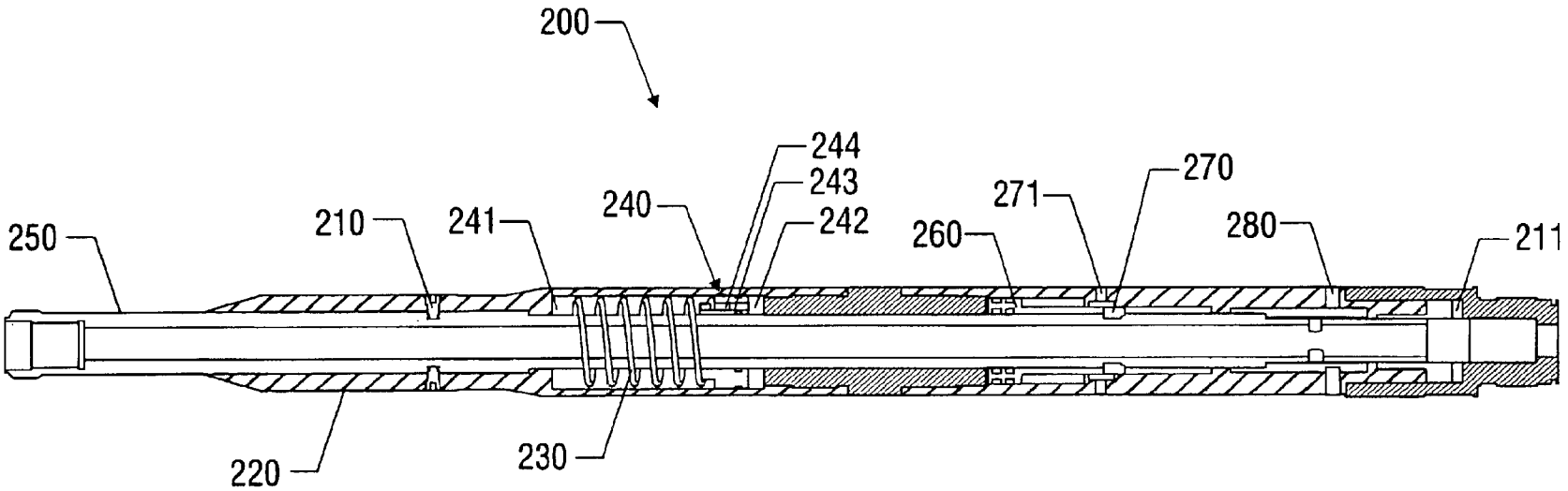
FIG. 16 shows the release tool of one embodiment of the bottom hole assembly with the segments driven out of the mandrel's grove and into the housing.
Figure 17:
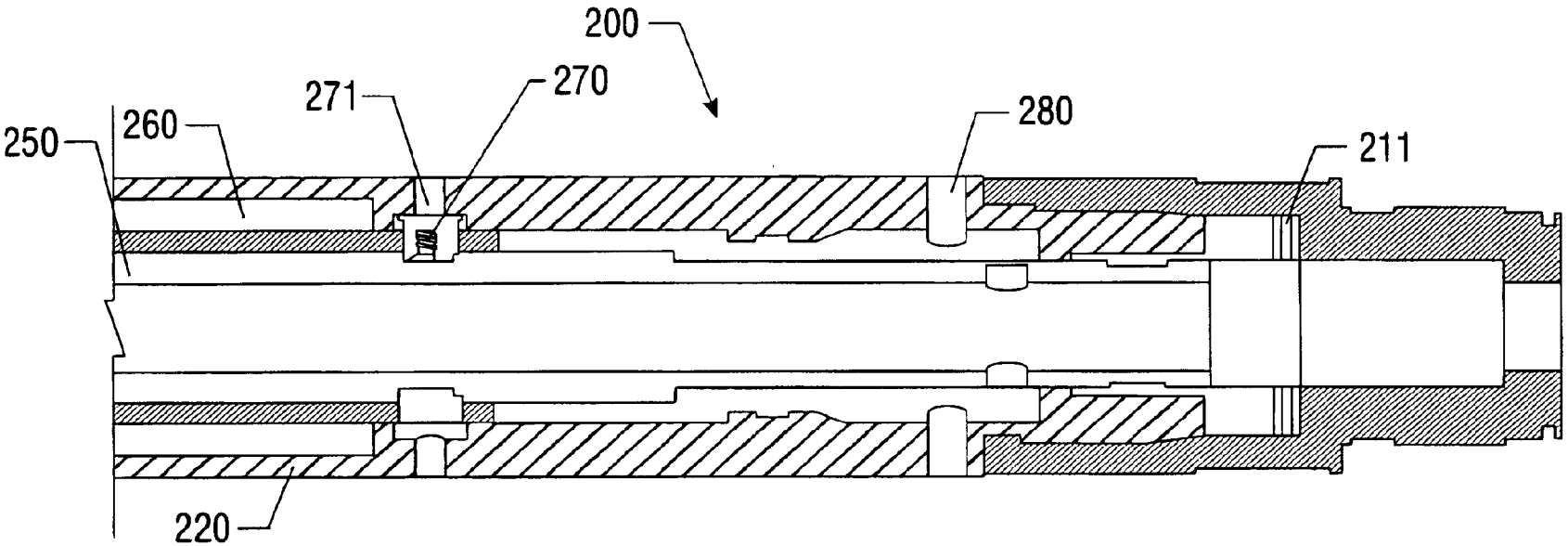
FIG. 17 shows a detailed view of the lower section of the release tool of FIG. 17.

Referring to FIGS. 13 and 14, stage two of the release process is initiated. Lower shear pins 211 are sheared, at, e.g., 32,000 lbs. pull. The stroke of the release tool mandrel 250 continues upwardly, e.g. 1.6", until upper shear pins 210 engage a shoulder on release tool mandrel 250. At this point, key 270 in lower piston 260 align with slot 271 in fishing neck housing 220 to release mandrel 250. FIG. 15 shows key 270 just prior to aligning with slot 271, and FIGS. 16 and 17 show the key 270 out of mandrel 250 and into slot 271. Circulating port 280 remains open. The tool may no longer be reset once the lower shear pins are sheared.

Figure 18:
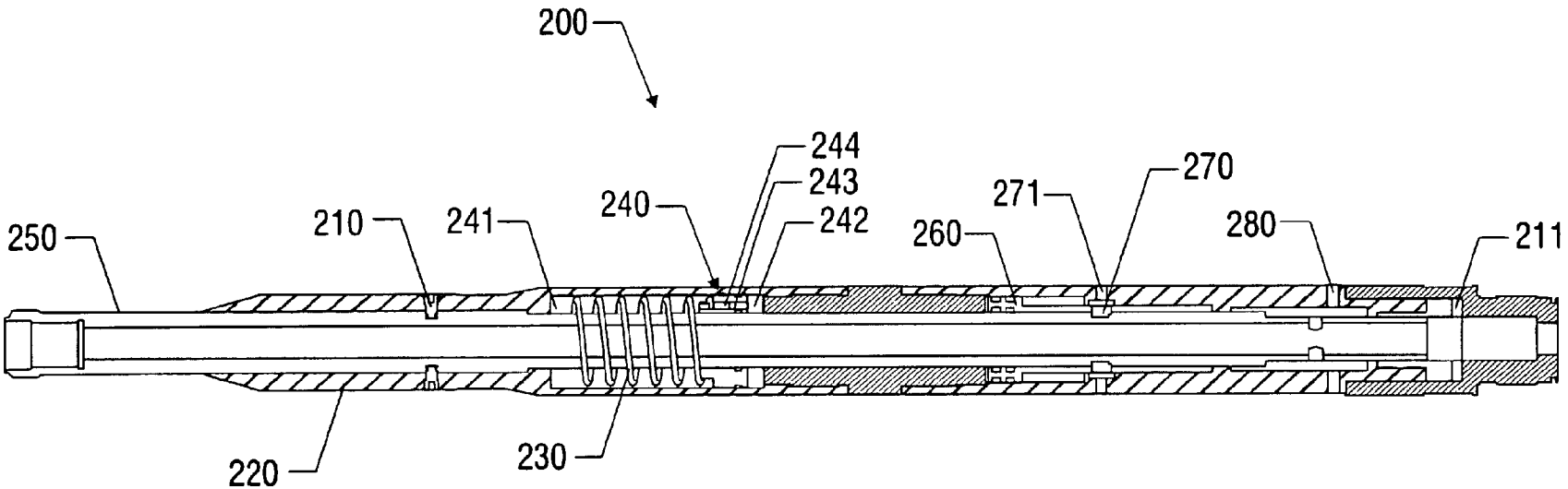
FIG. 18 shown the release tool of one embodiment of the bottom hole assembly being completely stroked with the circulating port open and the circulating shear pins sheared.
Figure 19:
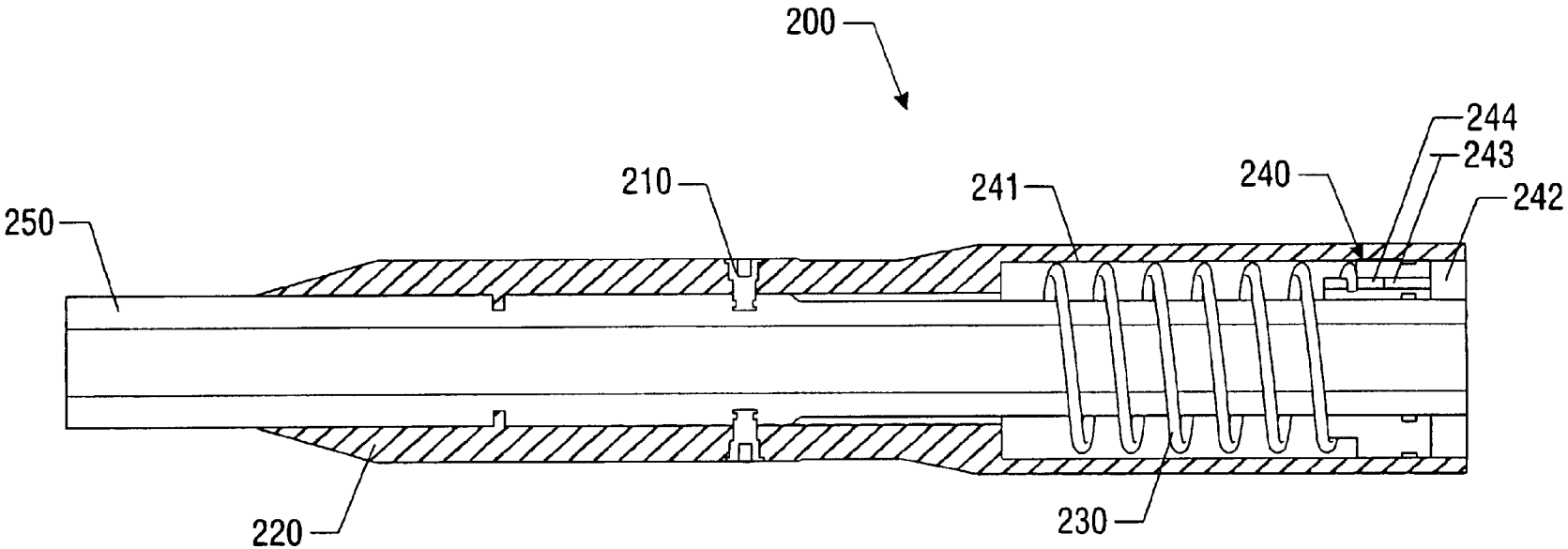
FIG. 19 shows the shoulder of the release tool of one embodiment of the bottom hole assembly at its final safety position.
Figure 20:
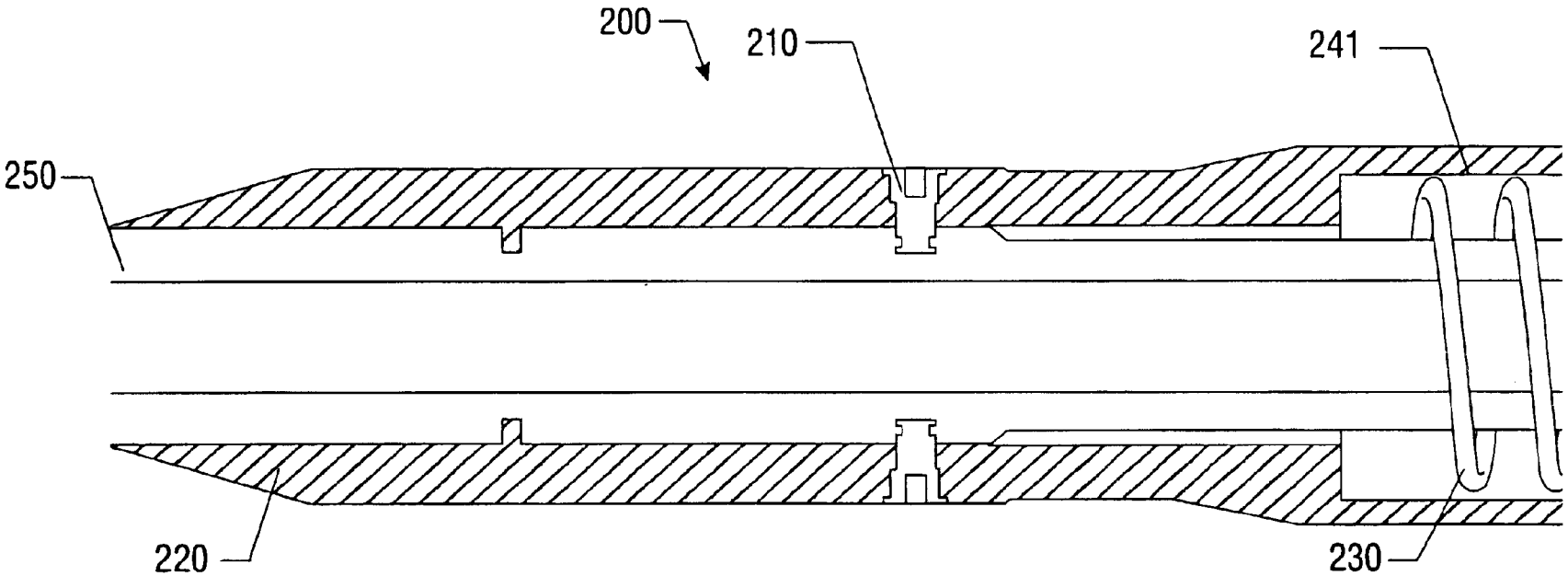
FIG. 20 shows a detailed view of the shoulder section of the release tool of FIG. 19.
Figure 21:
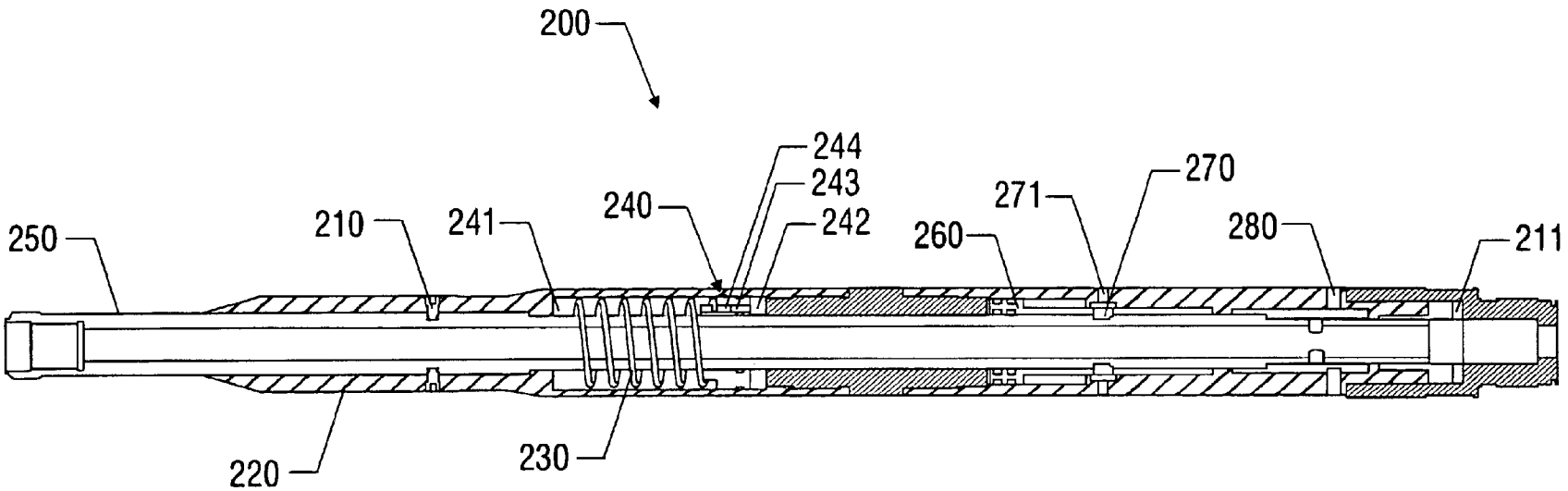
FIG. 21 shows the release tool of one embodiment of the bottom hole assembly with the release tool completely released.
Figure 22:
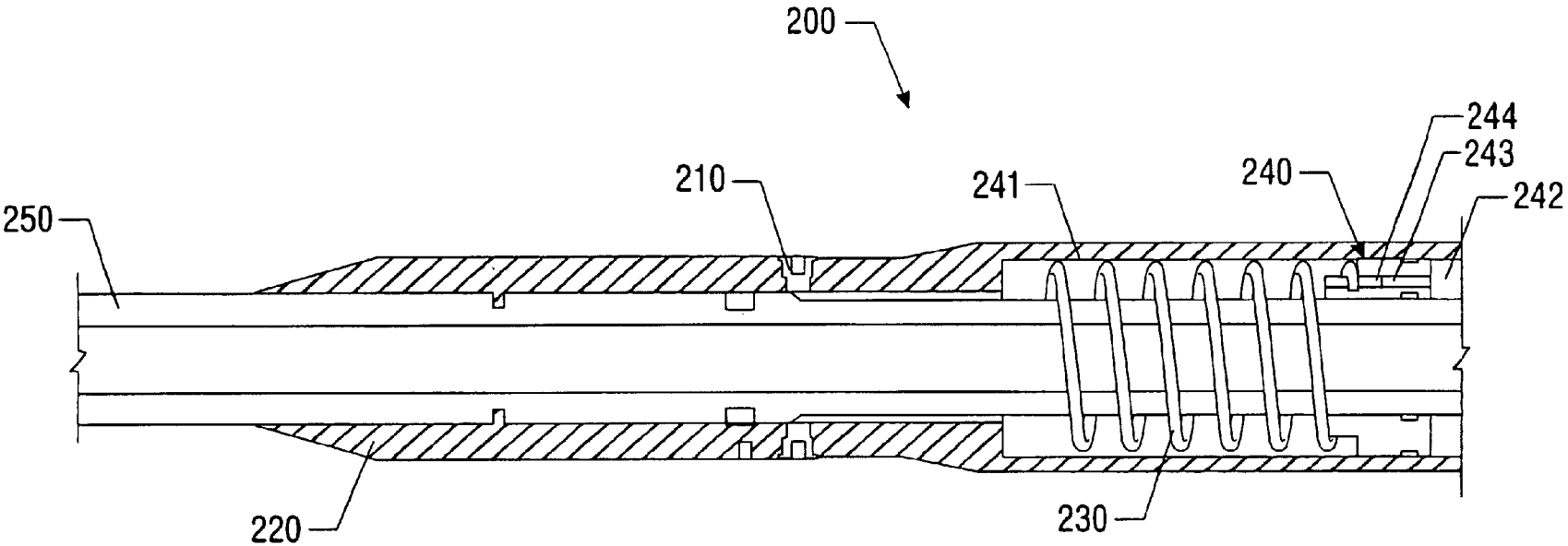
FIG. 22 shows a detailed view of FIG. 21.

With application of additional force, or the same force over a longer period of time, the release tool 200 moves to stage three. FIGS. 18–20 show the release tool 100% stroked just prior to release. The upper shear pins 210 are about to be sheared. As shown in FIG. 21, the upper shear pins 210 are sheared at a predetermined force, e.g. 32,000 pounds pull. Release tool mandrel 250 then pulls out of fishing neck housing 220 leaving the bottom hole assembly 100 in the well. The coiled tubing 40 is not open ended and cannot be reattached to the tool. FIGS. 21 and 22 show the release tool completely released.

Figure 23:
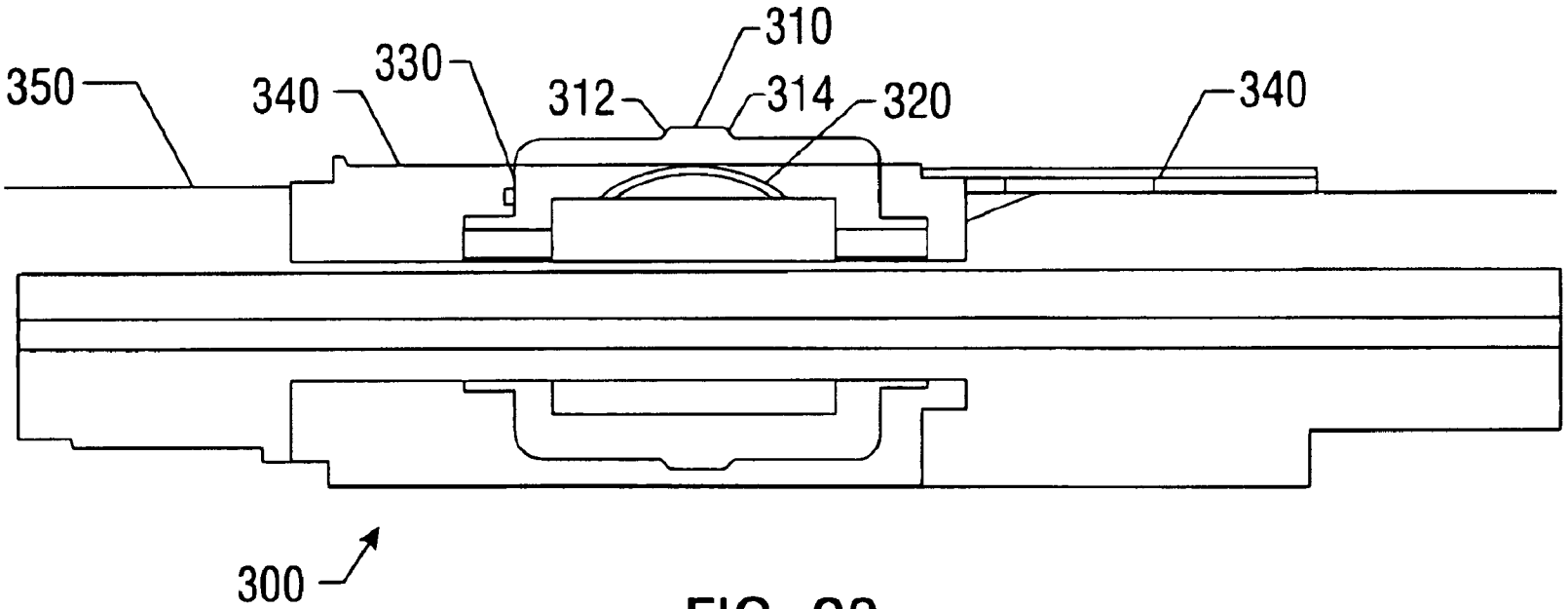
FIG. 23 shows one embodiment of a collar locator for use with embodiments of the bottom hole assemblies described herein.

Referring now to FIG. 23, a collar locator 300 for the bottom hole assembly 100 is shown. Although shown in each of FIGS. 2–6, the mechanical collar locator may or may not be used in conjunction with the bottom hole assembly described therewith. Similarly, the mechanical collar locator 300 may or may not be used in conjunction with the release tool 200 described herein.

The mechanical collar locator 300 is designed to function in a sand/fluid environment. The collar locator 300 may be used to accurately position the bottom hole assembly 100 at a depth in the well bore by referencing the collars that are in the casing 10.

The collar locator 300 may circumscribe a collar locator mandrel 350. The keys 310 are biased by the spring 320 in a radially outward-most position. The keys 310 are displaced inwardly in the radial direction from this position as dictated by the inner diameter of the casing 10. The keys are kept movably in place around mandrel 120 by key retainer 340.

As the collar locator 300 travels through the casing 10, the key 310 contacts the casing 10 and the collars therein. When the key 310 encounters a collar in the casing 10, the key 310 travels outwardly in the radial direction. To enter the next joint of casing, the key 310 must travel inwardly again, against the force of the spring 320. The upset located in the center of the key 310 has a leading edge 312. The angle of the leading edge 314 has been chosen such that the resulting axial force is sufficient to be detected at surface by the coil tubing operator when run into the hole.

The leading edge 312 angle for running in the hole is different than the trailing edge 314 for pulling out of the hole. Running in the hole yields axial loads of 100 lbs., and when pulling out of the hole the axial load is 1500 lbs.

The upset also has an angle on the trailing edge 314 that has been chosen such that the resulting axial force is sufficient to be detected at surface by the coil tubing operator when pulling out of the hole.

The collar locator 300 may withstand sandy fluids. The seal 330 prevents or reduces sand from entering the key cavity around the spring 320. The filter and port 340 allow fluid to enter and exhaust due to the volume change when the keys 310 travel in the radial direction.

While the compositions and methods of this invention have been described in terms of preferred embodiments, it will be apparent to those of skill in the art that variations may be applied to the process described herein without departing from the concept, spirit and scope of the invention. All such similar substitutes and modifications apparent to those skilled in the art are deemed to be within the spirit, scope and concept of the invention as it is set out in the following claims.

What is claimed is:

1. A bottom hole assembly for use with coiled tubing for fracturing a zone in a wellbore having a casing, comprising:

a hollow mandrel functionally associated with the coiled tubing, the mandrel surrounded by an outer housing, the outer housing and the casing forming an annulus therebetween;

an upper packing element;

a lower packing element, the upper and lower packing elements disposed around the outer housing such that the packing elements are capable of straddling the zone to be fraced and are capable of setting the bottom hole assembly in the casing when the elements are set;

an upper dump port in the outer housing, the upper dump port placing the annulus and a flow path within the hollow mandrel in fluid communication when an upward force is applied to the mandrel via the coiled tubing to deflate the upper and lower packing elements;

a timing mechanism to ensure the fluid communication continues for a predetermined time to prevent the dump port from closing before the bottom hole assembly is flushed; and a spring biasing the mendrel such that the dump port prevents the annulus and flow path from being in fluid communication.

2. The bottom hole assembly of claim 1 further comprising a lower dump port in the outer housing, the lower dump port placing the wellbore and the flow path in fluid communication to deflate the lower packing elements, the timing mechanism preventing the lower dump port from closing before the bottom hole assembly is flushed.

3. The bottom hole assembly of claim 1 in which the timing mechanism further comprises:

an upper compartment formed above a shelf on the mandrel, the spring within the upper compartment; and a lower compartment formed below the shelf on the mandrel, the upper and lower compartments enclosing hydraulic fluid, the mandrel defining a hole to place the upper and lower compartments in fluid communication to allow hydraulic fluid to pass between the compartments as the mandrel moves axially with respect to the outer housing, the spring and the hydraulic fluid acting to ensure the fluid communication between the annulus and the flow path continues for the predetermined amount of time.

4. The bottom hole assembly of claim 1 further comprising at least one orifice in the outer housing, the at least one orifice adapted to provide fluid communication through the mandrel and the outer housing so that a fracing slurry may proceed down the coiled tubing through the flow path in the hollow mandrel, and into the zone to be fraced.

5. The bottom hole assembly of claim 4, in which the at least one orifice further comprises two orifi.

6. The bottom hole assembly of claim 5 in which the two orifi form an angle for reducing erosion of the casing.

7. The bottom hole assembly of claim 6 in which the angle is 90 degrees.

8. The bottom hole assembly of claim 1 in which the hollow mandrel is comprised of carbourized steel.

9. The bottom hole assembly of claim 1 in which an outer diameter of the outer housing is substantially straight and substantially parallel with the casing to prevent sand from building up on the outer diameter of the housing.

10. The bottom hole assembly of claim 9 in which the flow path within the mandrel is substantially straight and substantially parallel with the casing to prevent sand from building up within the mandrel.

11. The bottom hole assembly of claim 10 in which the casing has an inner diameter of 4.5 inches and the outer diameter of the outer housing is 3.5 inches.

12. The bottom hole assembly of claim 9 in which an outer diameter of each packing element when deflated is equal to the outer diameter of the outer housing.

13. The bottom hole assembly according to claim 1 for connecting the coiled tubing to the bottom hole assembly, further comprising:

a collar locator adapted to detect collars in the casing to position the bottom hole assembly such that the packing elements straddle the zone to be fraced.

14. The bottom hole assembly according to claim 13 in which the collar locator further comprises:

a collar locator mandrel;

a key mounted within a key retainer and about the mandrel; and a spring, the spring being located between the mandrel and the keys to urge the key into contact with the casing.

15. The bottom hole assembly according to claim 14 further comprising a filter in a port to allow the key to move radially when encountering a collar in the casing.

16. The bottom hole assembly of claim 14 further comprising a seal adapted to allow the collar locator to be utilized during the fracing procedure.

17. The bottom hole assembly of claim 14 in which the key has a leading edge at a first angle and a trailing edge at a second angle, the first angle being such that a resulting axial force may be detected at surface by a coiled tubing operator when inserting the bottom hole assembly into the hole, the second angle being such that a resulting axial force may be detected at surface by the coiled tubing operator when removing the bottom hole assembly into the hole.

18. A bottom hole assembly for use with coiled tubing for fracturing a zone in a wellbore having a casing, comprising:

a hollow mandrel functionally associated with the coiled tubing, the mandrel surrounded by an outer housing, the outer housing and the casing forming an annulus therebetween;

an upper packing element;

a lower packing element, the upper and lower packing elements disposed around the outer housing such that the packing elements are capable of straddling the zone to be fraced and are capable of setting the bottom hole assembly in the casing when the elements are set;

an upper dump port in the outer housing, the upper dump port placing the annulus and a flow path within the hollow mandrel in fluid communication when an upward force is applied to the mandrel via the coiled tubing to deflate the upper and lower packing elements; and a timing mechanism to ensure the fluid communication continues for a predetermined time to prevent the dump port from closing before the bottom hole assembly is flushed;

an upper pressure boost piston in fluid communication with the flow path, the annulus, and the upper inflatable packing element; and an lower pressure boost piston in fluid communication with the flow path, the annulus, and the lower inflatable packing element, the upper and lower boost pistons operating to increase the pressure inside the upper and lower packing elements.

19. The bottom hole assembly according to claim 18 in which each pressure boost piston further comprises:

a base, and a surface, the basing having a larger cross sectional surface area than the surface, a pressure differential between a tubing pressure and an annulus pressure creating an upward force on the cross sectional surface area of the base to create the boost.

20. The bottom hole assembly according to claim 19 in which each pressure boost piston further comprises a filter.

21. A bottom hole assembly for use with coiled tubing for fracturing a zone in a wellbore having a casing, comprising:

a hollow mandrel functionally associated with the coiled tubing, the mandrel surrounded by an outer housing, the outer housing and the casing forming an annulus therebetween;

an upper packing element;

a lower packing element, the upper and lower packing elements disposed around the outer housing such that the packing elements are capable of straddling the zone to be fraced and are capable of setting the bottom hole assembly in the casing when the elements are set;

an upper dump port in the outer housing, the upper dump port placing the annulus and a flow oath within the hollow mandrel in fluid communication when an upward force is applied to the mandrel via the coiled tubing to deflate the upper and lower packing elements;

a timing mechanism to ensure the fluid communication continues for a predetermined time to prevent the dump port from closing before the bottom hole assembly is flushed;

an upper packer equalization port; and a lower packer equalization port, the upper and lower packer equalization ports functionally associated with an annular space between the mandrel and the outer housing to provide a fluid communication bypass from above the upper packing element to below the lower packing element.

22. The bottom hole assembly of claim 21 in which each packer equalization port further comprises a filter.

23. A bottom hole assembly for use with coiled tubing for fracturing a zone in a wellbore having a casing, comprising:

a hollow mandrel functionally associated with the coiled tubing, the mandrel surrounded by an outer housing, the outer housing and the casing forming an annulus therebetween;

an upper packing element;

a lower packing element, the upper and lower packing elements disposed around the outer housing such that the packing elements are capable of straddling the zone to be fraced and are capable of setting the bottom hole assembly in the casing when the elements are set;

an upper dump port in the outer housing, the upper dump port placing the annulus and a flow path within the hollow mandrel in fluid communication when an upward force is applied to the mandrel via the coiled tubing to deflate the upper and lower packing elements;

a timing mechanism to ensure the fluid communication continues for a predetermined time to prevent the dump port from closing before the bottom hole assembly is flushed;

at least one orifice in the outer housing, the at least one orifice adapted to provide fluid communication through the mandrel and the outer housing so that a fracing slurry may proceed down the coiled tubing through the flow path in the hollow mandrel, and into the zone to be fraced; and at lease one flow guide, the flow guide changing the direction of the slurry from down the flow path in the hollow mandrel into the zone to be fraced.

24. A bottom hole assembly for use with coiled tubing for fracturing a zone in a wellbore having a casing, comprising:

a hollow mandrel functionally associated with the coiled tubing, the mandrel surrounded by an outer housing, the outer housing and the casing forming an annulus therebetween;

an upper packing element;

a lower packing element, the upper and lower packing elements disposed around the outer housing such that the packing elements are capable of straddling the zone to be fraced and are capable of setting the bottom hole assembly in the casing when the elements are set;

an upper dump port in the outer housing, the upper dump port placing the annulus and a flow path within the hollow mandrel in fluid communication when an upward force is applied to the mandrel via the coiled tubing to deflate the upper and lower packing elements;

a timing mechanism to ensure the fluid communication continues for a predetermined time to prevent the dump port from closing before the bottom hole assembly is flushed; and a delay mechanism to prevent the packing elements from becoming instantaneously unset when the upward force is applied to the mandrel.

25. The bottom hole assembly of claim 24 in which the delay mechanism further comprises a flow restrictor.

26. A method of fracing a zone in a wellbore having a casing using coiled tubing, comprising:

providing a bottom hole assembly having a hollow mandrel functionally associated with the coiled tubing, the mandrel surrounded by an outer housing, the outer housing and the casing forming an annulus therebetween, an upper packing element, a lower packing element, the upper and lower packing elements disposed around the outer housing such that the packing elements are capable of straddling the zone to be fraced and are capable of setting the bottom hole assembly in the casing when the elements are set, an upper dump port in the outer housing, the upper dump port placing the annulus and a flow path within the hollow mandrel in fluid communication when an upward force is applied to the mandrel via the coiled tubing to unset the upper and lower packing elements, and a timing mechanism to ensure the fluid communication continues for a predetermined time to prevent the upper dump port from closing before the bottom hole assembly is flushed;

running the bottom hole assembly into the casing such that the packing elements straddle the zone to be fraced;

setting the upper and lower packing elements by increasing the flow through the flow path in the mandrel;

fracing the zone;

applying an upward force on the coiled tubing to unset the packing elements;

flushing the bottom hole assembly before resetting the packing elements;

providing a release tool having a release tool to connect the hollow mandrel with the coiled tubing, the release tool having a reset mechanism adapted to allow a user to attempt to dislodge the bottom hole assembly when the bottom hole assembly is lodged in the casing, without releasing the bottom hole assembly from the coiled wire tubing;

applying a predetermined force to the release tool via the coiled tubing to attempt to release the bottom hole assembly when the bottom hole assembly is lodged in the casing; and resetting the release tool to its original position once the upward force is no longer applied to the coiled tubing.

27. The method of claim 26 further comprising:

providing a collar locator; and using the collar locator to locate the zone to be fraced so that the packing elements may straddle the zone to be fraced.

* * * * *